US005453047A

United States Patent [19]

Mazur et al.

[11] Patent Number: 5,453,047

[45] Date of Patent: * Sep. 26, 1995

[54] COIN HANDLING SYSTEM

[75] Inventors: Richard A. Mazur, Naperville; Joseph J. Geib, Mt. Prospect; Gary Watts, Buffalo Grove; John Gibbons, Mt. Prospect; Rasmussen M. James, Chicago; Stephen G. Rudisill, Kildeer, all of Ill.

[73] Assignee: Cummins-Allison Corp., Mount Prospect, Ill.

[ * ] Notice: The portion of the term of this patent subsequent to Apr. 5, 2011 has been disclaimed.

[21] Appl. No.: 127,897

[22] Filed: Sep. 28, 1993

Related U.S. Application Data

[60] which is a continuation of Ser. No. 951,731, Sep. 25, 1992, Pat. No. 5,299,977, which is a continuation-in-part of Ser. No. 904,161, Aug. 21, 1992, Pat. No. 5,277,651, which is a continuation of Ser. No. 524,134, May 14, 1990, Pat. No. 5,141,443.

[51] Int. Cl.[6] ..... G07D 3/16

[52] U.S. Cl. ..... 453/10; 453/57

[58] Field of Search ..... 453/6, 10, 32, 453/57

[56] References Cited

U.S. PATENT DOCUMENTS

| | | | |
|---|---|---|---|
| 4,407,312 | 10/1983 | Davila et al. | 453/32 |
| 4,681,128 | 7/1987 | Ristvedt et al. | 453/6 |
| 4,731,043 | 3/1988 | Ristvedt et al. | 453/6 |
| 4,753,625 | 6/1988 | Okada | 453/32 |
| 5,055,086 | 10/1991 | Raterman et al. | 453/10 |
| 5,141,443 | 8/1992 | Rasmussen et al. | 453/10 |
| 5,299,977 | 4/1994 | Mazur et al. | 453/10 |

*Primary Examiner*—F. J. Bartuska
*Attorney, Agent, or Firm*—Arnold, White & Durkee

[57] ABSTRACT

A coin sorter for sorting mixed coins by denomination. The apparatus comprises a rotatable disc which has a resilient surface for receiving coins and imparting rotational movement to the coins. A stationary sorting head has a contoured surface spaced slightly away from and generally parallel to the resilient surface of the rotatable disc. The stationary sorting head sorts and discharges coins of different denominations at different exits around the periphery of the stationary sorting head. The sorting head includes a separate exit channel for each denomination of coin, and a sensor for each coin denomination within the exit channel for that denomination. An encoder monitors the movement of a sensed coin on the rotating disc downstream of the sensors by monitoring the angular movement of the disc.

6 Claims, 26 Drawing Sheets

COIN HANDLING SYSTEM

CROSS-REFERENCE TO RELATED APPLICATION

This application is a continuation of application Ser. No. 07/951,731, filed Sep. 25, 1992 now U.S. Pat. No. 5,299,997, which in turn is a continuation-in-part of application Ser. No. 07/904,161, filed Aug. 21, 1992 now U.S. Pat. No. 5,277,651, which is a continuation of application Ser. No. 07/524,134, filed May 14, 1990 now U.S. Pat. No. 5,141,443.

FIELD OF THE INVENTION

The present invention relates generally to coin handling systems and, more particularly, to coin handling systems of the type which use a resilient disc rotating beneath a stationary coin-manipulating head.

SUMMARY OF THE INVENTION

It is a primary object of the present invention to provide an improved coin handling system which reliably terminates the discharge of coins after only a prescribed number of coins of a prescribed denomination have been discharged, so that no extra coins of that denomination are discharged. A related object is to provide an improved coin handling system which avoids the need to retrieve discharged coins in excess of a prescribed number.

Another related object of the invention is to provide a coin handling system which permits coins to be sensed for counting and bag stopping control either before or after the coins have been sorted.

Another important object of this invention is to provide such an improved coin handling system which is inexpensive to manufacture.

Other objects and advantages of the invention will be apparent from the following detailed description and the accompanying drawings.

In accordance with the present invention, the foregoing objectives are realized by providing a coin handling system which includes a rotatable disc having a resilient surface for receiving coins and imparting rotational movement to the coins; a drive motor for rotating the disc; and a stationary coinmanipulating head having a contoured surface spaced slightly away from and generally parallel to the resilient surface of the rotatable disc. Manipulated coins are discharged from the disc at one or more exits at the periphery of the disc and/or the stationary head, and the coins are sensed for counting and/or control purposes at a sensing station located upstream of the exit. Movement of sensed coins downstream of the sensing station is monitored by monitoring the angular movement of the rotating disc, to determine when a sensed coin has been moved to a predetermined location downstream of the sensing station, in the direction of coin movement.

The system of this invention can be used in coin sorters or coin loaders (e.g., for loading wrapping machines) to control the automatic stopping of coin discharge when a prescribed number of coins have been discharged, to prevent the discharge of undesired excess coins.

BRIEF DESCRIPTION OF THE DRAWINGS

FIG. 21 is a fragmentary section of a modification of the sorting head of

FIG. 2;

DESCRIPTION OF THE PREFERRED EMBODIMENTS

Figure 1:
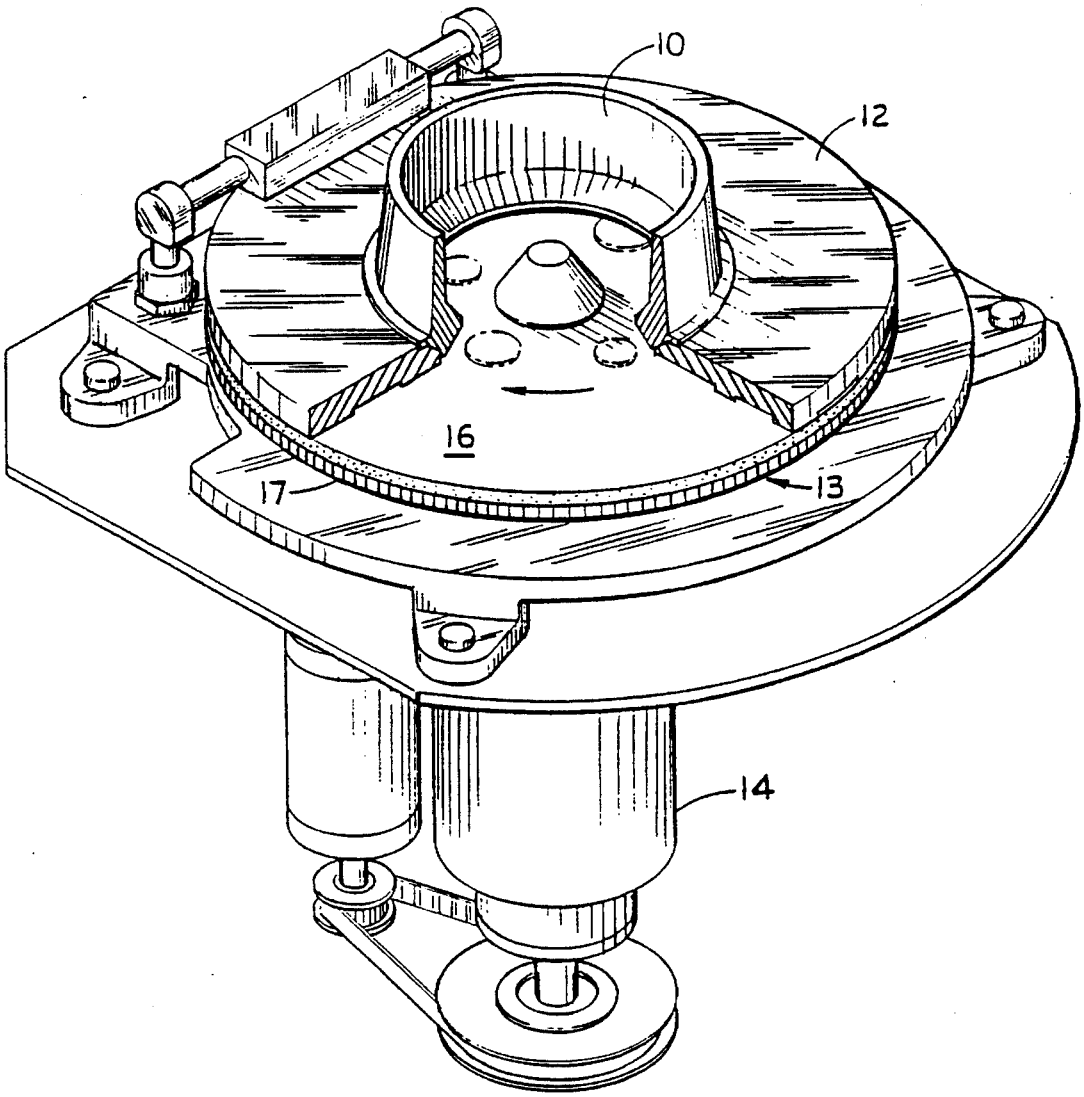
FIG. 1 is perspective view of a coin counting and sorting system embodying the present invention, with portions thereof broken away to show the internal structure.

While the invention is susceptible to various modifications and alternative forms, certain specific embodiments thereof have been shown by way of example in the drawings and will be described in detail. It should be understood, however, that it is not intended to limit the invention to the particular forms described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through central openings in an annular sorting head or guide plate 12. As the coins pass through these openings, they are deposited on the top surface of a rotatable disc 13. This disc 13 is mounted for rotation on a stub shaft (not shown) and driven by an electric motor 14. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin.

Figure 2:
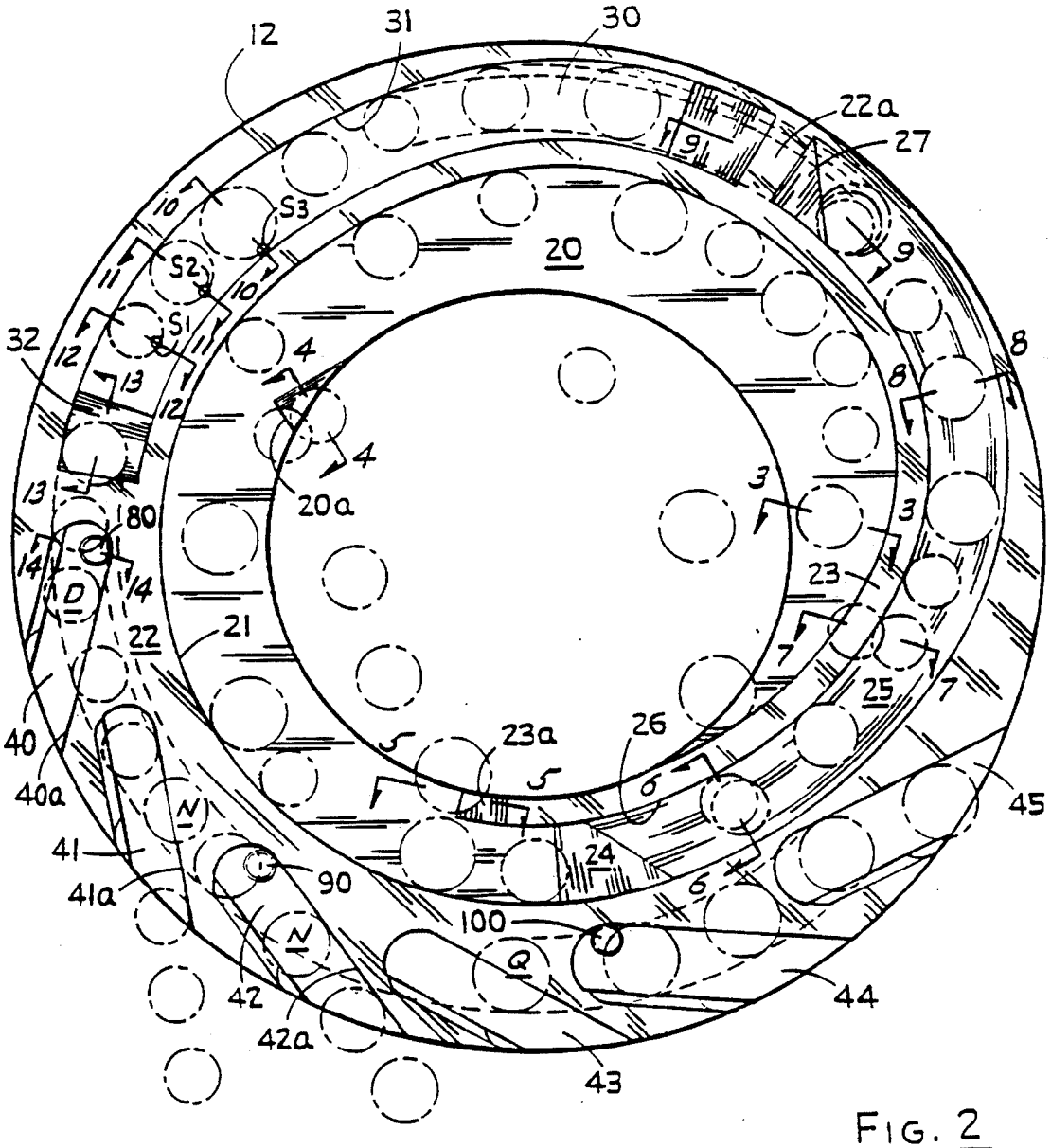
FIG. 2 is an enlarged bottom plan view of the sorting head or guide plate in the system of FIG. 1.
Figure 3:
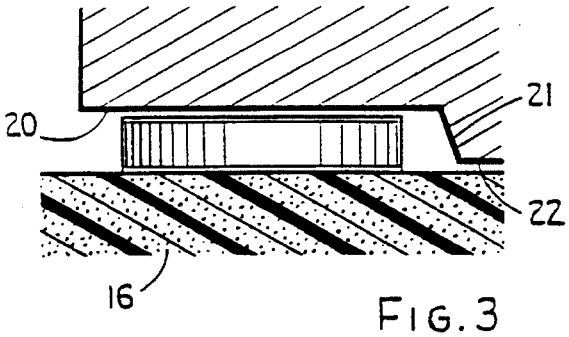
FIG. 3 is an enlarged section taken generally along line 3—3 in FIG. 2.
Figure 4:
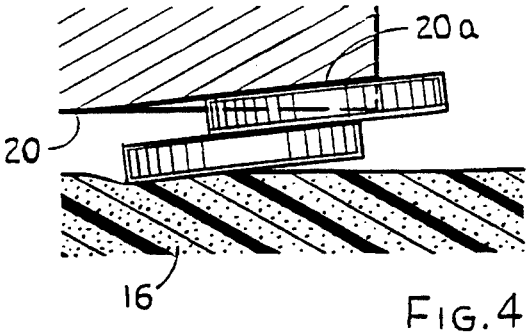
FIG. 4 is an enlarged section taken generally along line 4—4 in FIG. 2.

As can be seen most clearly in FIG. 2, the outwardly moving coins initially enter an annular recess 20 formed in the underside of the guide plate 12 and extending around a major portion of the inner periphery of the annular guide plate. The outer wall 21 of the recess 20 extends downwardly to the lowermost surface 22 of the guide plate (see FIG. 3), which is spaced from the top surface of the pad 16 by a distance which is slightly less, e.g., 0.010 inch, than the thickness of the thinnest coins. Consequently, the initial radial movement of the coins is terminated when they engage the wall 21 of the recess 20, though the coins continue to move circumferentially along the wall 21 by the rotational movement of the pad 16. Overlapping coins which only partially enter the recess 20 are stripped apart by a notch 20*a* formed in the top surface of the recess 20 along its inner edge (see FIG. 4).

Figure 5:
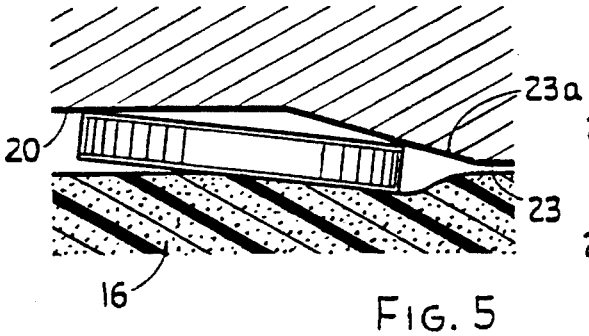
FIG. 5 is an enlarged section taken generally along line 5—5 in FIG. 2.

The only portion of the central opening of the guide plate 12 which does not open directly into the recess 20 is that sector of the periphery which is occupied by a land 23 whose lower surface is at the same elevation as the lowermost surface 22 of the guide plate. The upstream end of the land 23 forms a ramp 23*a* (FIG. 5), which prevents certain coins stacked on top of each other from reaching the ramp 24. When two or more coins are stacked on top of each other, they may be pressed into the resilient pad 16 even within the deep peripheral recess 20. Consequently, stacked coins can be located at different radial positions within the channel 20 as they approach the land 23. When such a pair of stacked coins has only partially entered the recess 20, they engage the ramp 23*a* on the leading edge of the land 23. The ramp 23*a* presses the stacked coins downwardly into the resilient pad 16, which retards the lower coin while the upper coin continues to be advanced. Thus, the stacked coins are stripped apart so that they can be recycled and once again enter the recess 20, this time in a single layer.

When a stacked pair of coins has moved out into the recess 20 before reaching the land 23, the stacked coins engage the inner spiral wall 26. The vertical dimension of the wall 26 is slightly less than the thickness of the thinnest coin, so the lower coin in a stacked pair passes beneath the wall and is recycled while the upper coin in the stacked pair is cammed outwardly along the wall 26 (see FIGS. 6 and 7). Thus, the two coins are stripped apart with the upper coin moving along the guide wall 26, while the lower coin is recycled.

As coins within the recess 20 approach the land 23, those coins move outwardly around the land 23 and engage a ramp 24 leading into a recess 25 which is an outward extension of the inner peripheral recess 20. The recess 25 is preferably just slightly wider than the diameter of the coin denomination having the greatest diameter. The top surface of the major portion of the recess 25 is spaced away from the top of the pad 16 by a distance that is less than the thickness of the thinnest coin so that the coins are gripped between the guide plate 12 and the resilient pad 16 as they are rotated through the recess 25. Thus, coins which move into the recess 25 are all rotated into engagement with the outwardly spiralling inner wall 26, and then continue to move outwardly through the recess 25 with the inner edges of all the coins riding along the spiral wall 26.

Figure 6:
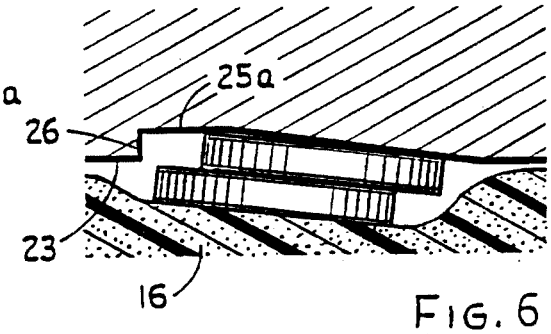
FIG. 6 is an enlarged section taken generally along line 6—6 in FIG. 2.
Figure 7:
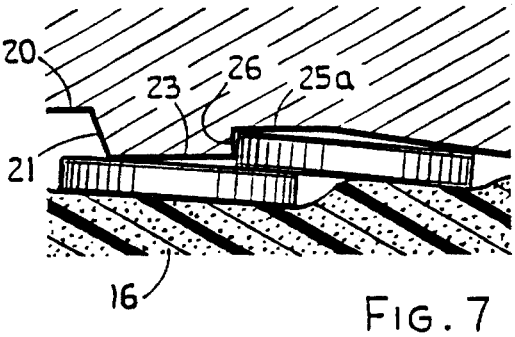
FIG. 7 is an enlarged section taken generally along line 7—7 in FIG. 2.
Figure 8:
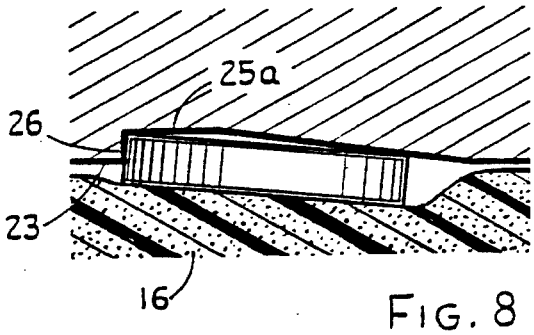
FIG. 8 is an enlarged section taken generally along line 8—8 in FIG. 2.

As can be seen in FIGS. 6–8, a narrow band 25*a* of the top surface of the recess 25 adjacent its inner wall 26 is spaced away from the pad 16 by approximately the thickness of the thinnest coin. This ensures that coins of all denominations (but only the upper coin in a stacked or shingled pair) are securely engaged by the wall 26 as it spirals outwardly. The rest of the top surface of the recess 25 tapers downwardly from the band 25*a* to the outer edge of the recess 25. This taper causes the coins to be tilted slightly as they move through the recess 25, as can be seen in FIGS. 6–8, thereby further ensuring continuous engagement of the coins with the outwardly spiraling wall 26.

The primary purpose of the outward spiral formed by the wall 26 is to space apart the coins so that during normal steady-state operation of the sorter, successive coins will not be touching each other. As will be discussed below, this spacing of the coins contributes to a high degree of reliability in the counting of the coins.

Figure 9:
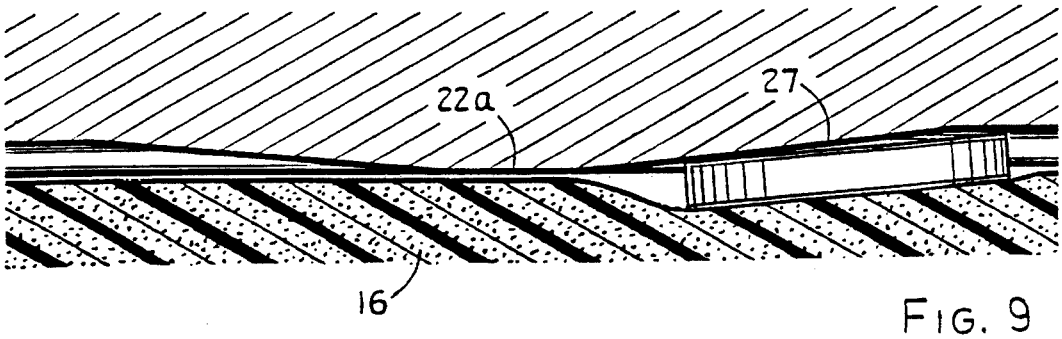
FIG. 9 is an enlarged section taken generally along line 9—9 in FIG. 2.
Figure 10:
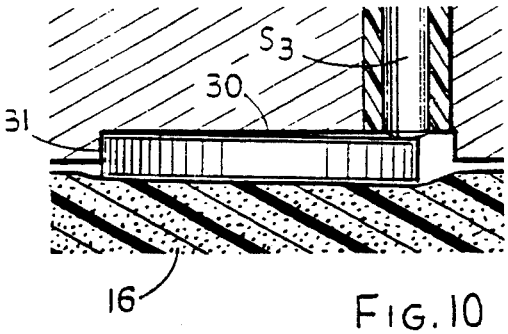
FIG. 10 is an enlarged section taken generally along line 10—10 in FIG. 2.
Figure 11:
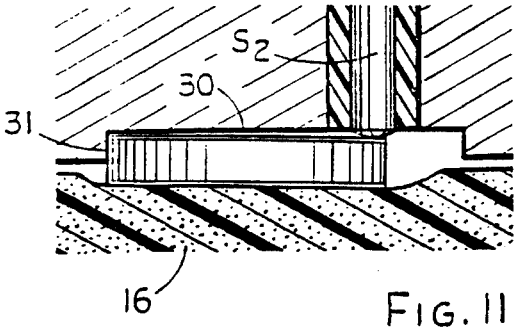
FIG. 11 is an enlarged section taken generally along line 11—11 in FIG. 2.
Figure 12:
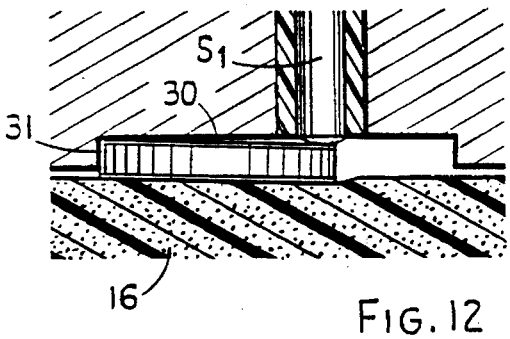
FIG. 12 is an enlarged section taken generally along line 12—12 in FIG. 2.

Rotation of the pad 16 continues to move the coins along the wall 26 until those coins engage a ramp 27 sloping downwardly from the recess 25 to a region 22*a* of the lowermost surface 22 of the guide plate 12 (see FIG. 9). Because the surface 22 is located even closer to the pad 16 than the recess, the effect of the ramp 27 is to further depress the coins into the resilient pad 16 as the coins are advanced along the ramp by the rotating disc. This causes the coins to be even more firmly gripped between the guide plate surface region 22*a* and the resilient pad 16, thereby securely holding the coins in a fixed radial position as they continue to be rotated along the underside of the guide plate by the rotating disc.

As the coins emerge from the ramp 27, the coins enter a referencing and counting recess 30 which still presses all coin denominations firmly against the resilient pad 16. The outer edge of this recess 30 forms an inwardly spiralling wall 31 which engages and precisely positions the outer edges of the coins before the coins reach the exit channels which serve as means for discriminating among coins of different denominations according to their different diameters.

The inwardly spiralling wall 31 reduces the spacing between successive coins, but only to a minor extent so that successive coins remain spaced apart. The inward spiral closes any spaces between the wall 31 and the outer edges of the coins so that the outer edges of all the coins are eventually located at a common radial position, against the wall 31, regardless of where the outer edges of those coins were located when they initially entered the recess 30.

Figure 13:
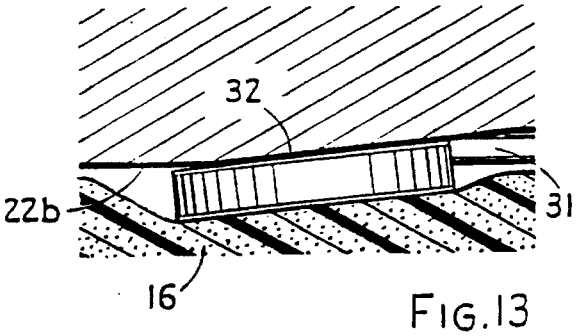
FIG. 13 is an enlarged section taken generally along line 13—13 in FIG. 2.

At the downstream end of the referencing recess 30, a ramp 32 (FIG. 13) slopes downwardly from the top surface of the referencing recess 30 to region 22*b* of the lowermost surface 22 of the guide plate. Thus, at the downstream end of the ramp 32 the coins are gripped between the guide plate 12 and the resilient pad 16 with the maximum compressive force. This ensures that the coins are held securely in the radial position initially determined by the wall 31 of the referencing recess 30.

Beyond the referencing recess 30, the guide plate 12 forms a series of exit channels 40, 41, 42, 43, 44 and 45 which function as selecting means to discharge coins of different denominations at different circumferential locations around the periphery of the guide plate. Thus, the channels 40–45 are spaced circumferentially around the outer periphery of the plate 12, with the innermost edges of successive pairs of channels located progressively farther away from the common radial location of the outer edges of all coins for receiving and ejecting coins in order of increasing diameter. In the particular embodiment illustrated, the six channels 40–45 are positioned and dimensioned to eject only dimes (channels 40 and 41), nickels (channels 42 and 43) and quarters (channel 44 and 45). The innermost edges of the exit channels 40–45 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

For example, the first two exit channels 40 and 41 (FIGS. 2 and 14) are intended to discharge only dimes, and thus the innermost edges 40*a* and 41*a* of these channels are located at a radius that is spaced inwardly from the radius of the referencing wall 31 by a distance that is only slightly greater than the diameter of a dime. Consequently, only dimes can enter the channels 40 and 41. Because the outer edges of all denominations of coins are located at the same radial position when they leave the referencing recess 30, the inner edges of the nickels and quarters all extend inwardly beyond the innermost edge 40*a* of the channel 40, thereby preventing these coins from entering that particular channel. This is illustrated in FIG. 2 which shows a dime D captured in the channel 40, while nickels N and quarters Q bypass the channel 40 because their inner edges extend inwardly beyond the innermost edge 40*a* of the channel so that they remain gripped between the guide plate surface 22*b* and the resilient pad 16.

Of the coins that reach channels 42 and 43, the inner edges of only the nickels are located close enough to the periphery of the guide plate 12 to enter those exit channels. The inner edges of the quarters extend inwardly beyond the innermost edge of the channels 42 and 43 so that they remain gripped between the guide plate and the resilient pad. Consequently, the quarters are rotated past the channel 41 and continue on to the next exit channel. This is illustrated in FIG. 2 which shows nickels N captured in the channel 42, while quarters Q bypass the channel 42 because the inner edges of the quarters extend inwardly beyond the innermost edge 42*a* of the channel.

Similarly, only quarters can enter the channels 44 and 45, so that any larger coins that might be accidentally loaded into the sorter are merely recirculated because they cannot enter any of the exit channels.

Figure 14:
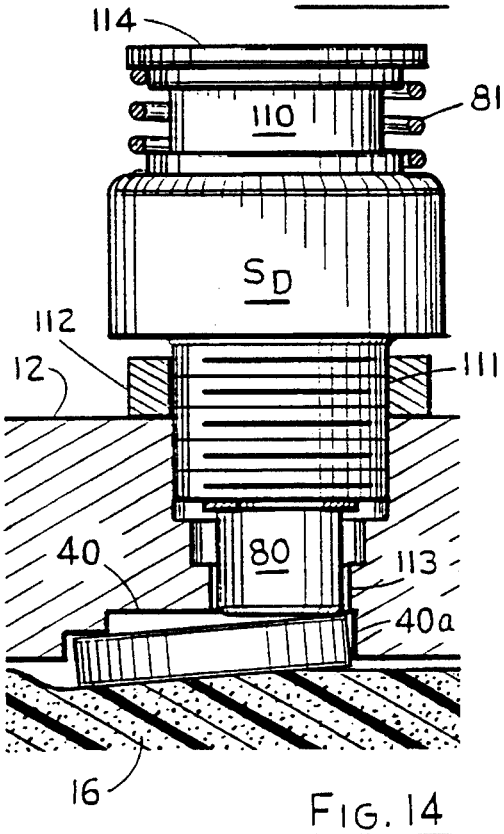
FIG. 14 is an enlarged section taken generally along line 14—14 in FIG. 2, and illustrating a coin in the exit channel with the movable element in that channel in its retracted position.

The cross-sectional profile of the exit channels 40–45 is shown most clearly in FIG. 14, which is a section through the dime channel 40. Of course, the cross-sectional configurations of all the exit channels are similar; they vary only in their widths and their circumferential and radial positions. The width of the deepest portion of each exit channel is smaller than the diameter of the coin to be received and ejected by that particular exit channel, and the stepped surface of the guide plate adjacent the radially outer edge of each exit channel presses the outer portions of the coins received by that channel into the resilient pad so that the inner edges of those coins are tilted upwardly into the channel (see FIG. 14). The exit channels extend outwardly to the periphery of the guide plate so that the inner edges of the channels guide the tilted coins outwardly and eventually eject those coins from between the guide plate 12 and the resilient pad 16.

The first dime channel 40, for example, has a width which is less than the diameter of the dime. Consequently, as the dime is moved circumferentially by the rotating disc, the inner edge of the dime is tilted upwardly against the inner wall 40a which guides the dime outwardly until it reaches the periphery of the guide plate 12 and eventually emerges from between the guide plate and the resilient pad. At this point the momentum of the coin causes it to move away from the sorting head into an arcuate guide which directs the coin toward a suitable receptacle, such as a coin bag or box.

Figure 17:
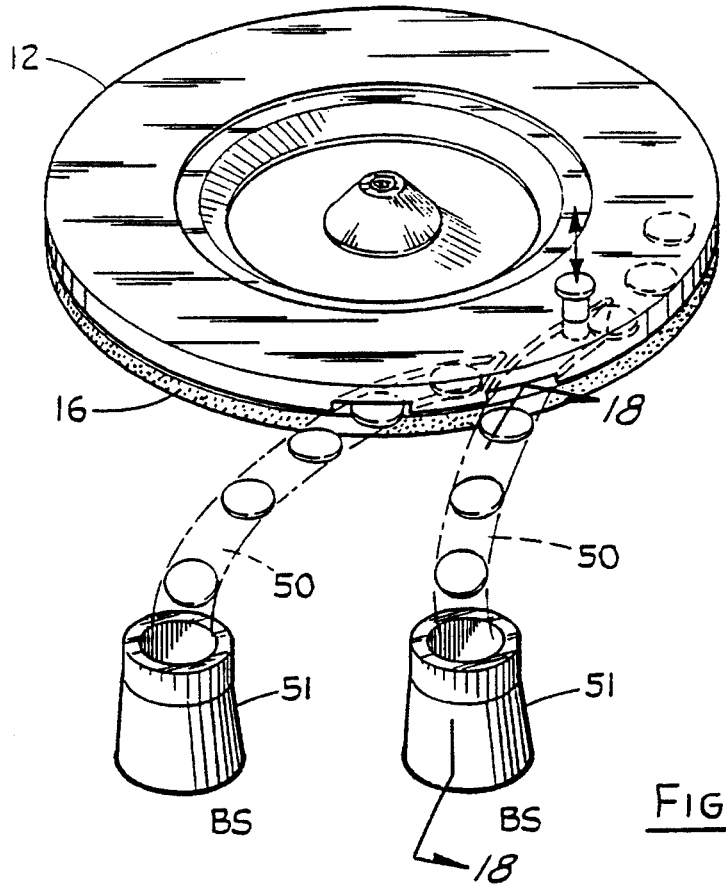
FIG. 17 is a perspective view of a portion of the coin sorter of FIG. 1, showing two of the six coin discharge and bagging stations and certain of the components included in those stations.
Figure 18:
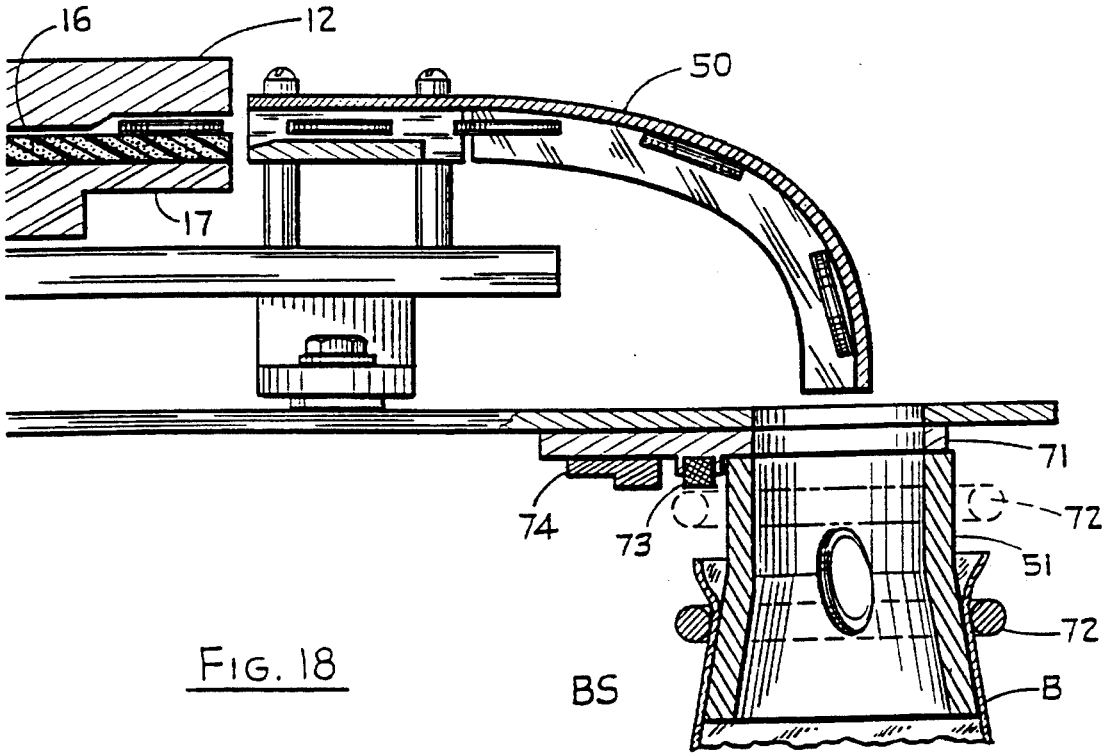
FIG. 18 is an enlarged section taken generally along line 18—18 in FIG. 17 and showing additional details of one of the coin discharge and bagging station.

As coins are discharged from the six exit channels 40–45, the coins are guided down toward six corresponding bag stations BS by six arcuate guide channels 50, as shown in FIGS. 17 and 18. Only two of the six bag stations BS are illustrated in FIG. 17, and one of the stations is illustrated in FIG. 18.

As the coins leave the lower ends of the guide channels 50, they enter corresponding cylindrical guide tubes 51 which are part of the bag stations BS. The lower ends of these tubes 51 flare outwardly to accommodate conventional clamping-ring arrangements for mounting coin bags B directly beneath the tubes 51 to receive coins therefrom.

As can be seen in FIG. 18, each clamping-ring arrangement includes a support bracket 71 below which the corresponding coin guide tube 51 is supported in such a way that the inlet to the guide tube is aligned with the outlet of the corresponding guide channel. A clamping ring 72 having a diameter which is slightly larger than the diameter of the upper portions of the guide tubes 51 is slidably disposed on each guide tube. This permits a coin bag B to be releasably fastened to the guide tube 51 by positioning the mouth of the bag over the flared end of the tube and then sliding the clamping ring down until it fits tightly around the bag on the flared portion of the tube, as illustrated in FIG. 18. Releasing the coin bag merely requires the clamping ring to be pushed upwardly onto the cylindrical section of the guide tube. The clamping ring is preferably made of steel, and a plurality of magnets 73 are disposed on the underside of the support bracket 71 to hold the ring 72 in its released position while a full coin bag is being replaced with an empty bag.

Each clamping-ring arrangement is also provided with a bag interlock switch for indicating the presence or absence of a coin bag at each bag station. In the illustrative embodiment, a magnetic reed switch 74 of the "normally-closed" type is disposed beneath the bracket 71 of each clamping-ring arrangement. The switch 74 is adapted to be activated when the corresponding clamping ring 72 contacts the magnets 73 and thereby conducts the magnetic field generated by the magnets 73 into the vicinity of the switch 74. This normally occurs when a previously clamped full coin bag is released and has not yet been replaced with an empty coin bag. A similar mechanism is provided for each of the other bag stations BS.

As described above, two different exit channels are provided for each coin denomination. Consequently, each coin denomination can be discharged at either of two different locations around the periphery of the guide plate 12, i.e., at the outer ends of the channels 40 and 41 for the dimes, at the outer ends of the channels 43 and 44 for the nickels, and at the outer ends of the channels 45 and 46 for the quarters. In order to select one of the two exit channels available for each denomination, a controllably actuatable shunting device is associated with the first of each of the three pairs of similar exit channels 40–41, 42–43 and 44–45. When one of these, shunting devices is actuated, it shunts coins of the corresponding denomination from the first to the second of the two exit channels provided for that particular denomination.

Turning first to the pair of exit channels 40 and 41 provided for the dimes, a vertically movable bridge 80 is positioned adjacent the inner edge of the first channel 40, at the entry end of that channel. This bridge 80 is normally held in its raised, retracted position by means of a spring 81 (FIG. 14), as will be described in more detail below. When the bridge 80 is in this raised position, the bottom of the bridge is flush with the top wall of the channel 40, as shown in FIG. 14, so that dimes D enter the channel 40 and are discharged through that channel in the normal manner.

When it is desired to shunt dimes past the first exit channel 40 to the second exit channel 41, a solenoid $S_D$ (FIGS. 14, 15 and 19) is energized to overcome the force of the spring 81 and lower the bridge 80 to its advanced position. In this lowered position, shown in FIG. 15, the bottom of the bridge 80 is flush with the lowermost surface 22*b* of the guide plate 12, which has the effect of preventing dimes D from entering the exit channel 40. Consequently, the quarters are rotated past the exit channel 40 by the rotating disc, sliding across the bridge 80, and enter the second exit channel 41.

To ensure that precisely the desired number of dimes are discharged through the exit channel 40, the bridge 80 must be interposed between the last dime for any prescribed batch and the next successive dime (which is normally the first dime for the next batch). To facilitate such interposition of the bridge 80 between two successive dimes, the dimension of the bridge 80 in the direction of coin movement is relatively short, and the bridge is located along the edges of the coins, where the space between successive coins is at a maximum. The fact that the exit channel 40 is narrower than the coins also helps ensure that the outer edge of a coin will not enter the exit channel while the bridge is being moved from its retracted position to its advanced position. In fact, with the illustrative design, the bridge 80 can be advanced after a dime has already partially entered the exit channel 40, overlapping all or part of the bridge, and the bridge will still shunt that dime to the next exit channel 41.

Vertically movable bridges 90 and 100 (FIG. 2) located in the first exit channels 42 and 44 for the nickels and quarters, respectively, operate in the same manner as the bridge 80. Thus, the nickel bridge 90 is located along the inner edge of the first nickel exit channel 42, at the entry end of that exit channel. The bridge 90 is normally held in its raised, retracted position by means of a spring. In this raised position the bottom of the bridge 90 is flush with the top wall of the exit channel 42, so that nickels enter the channel 42 and are discharged through that channel. When it is desired to divert nickels to the second exit channel 43, a solenoid $S_N$ (FIG. 19) is energized to overcome the force of the spring and lower the bridge 90 to its advanced position, where the bottom of the bridge 60 is flush with the lowermost surface 22*b* of the guide plate 12. When the bridge 90 is in this advanced position, the bridge prevents any coins from entering the first exit channel 42. Consequently, the nickels slide across the bridge 90, continue on to the second exit channel 43 and are discharged therethrough. The quarter bridge 100 (FIG. 2) and its solenoid $S_Q$ (FIG. 19) operate in exactly the same manner. The edges of all the bridges 80, 90 and 100 are preferably chamfered to prevent coins from catching on these edges.

Figure 15:
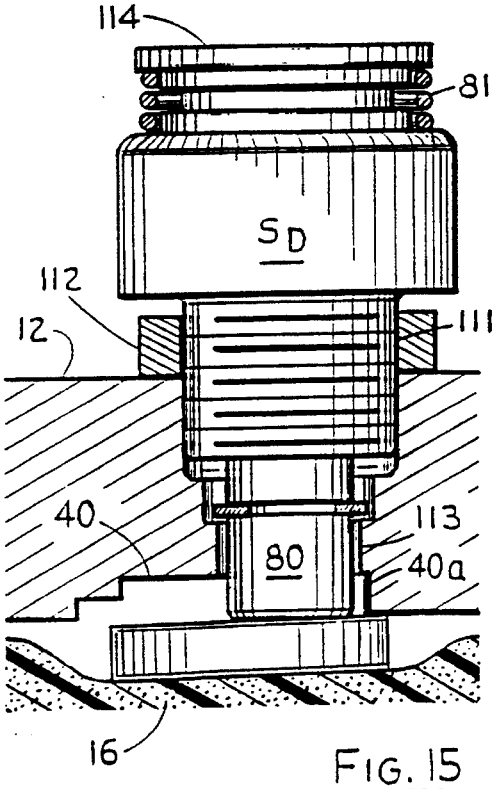
FIG. 15 is the same section shown in FIG. 14 with the movable element in its advanced position.

The details of the actuating mechanism for the bridge 80 are illustrated in FIGS. 14 and 15. The bridges 90 and 100 have similar actuating mechanisms, and thus only the mechanism for the bridge 80 will be described. The bridge 80 is mounted on the lower end of a plunger 110 which slides vertically through a guide bushing 111 threaded into a hole bored into the guide plate 12. The bushing 111 is held in place by a locking nut 112. A smaller hole 113 is formed in the lower portion of the plate 12 adjacent the lower end of the bushing 111, to provide access for the bridge 80 into the exit channel 40. The bridge 80 is normally held in its retracted position by the coil spring 81 compressed between the locking nut 112 and a head 114 on the upper end of the plunger 110. The upward force of the spring 81 holds the bridge 80 against the lower end of the bushing 111.

To advance the plunger 110 to its lowered position within the exit channel 40 (FIG. 15), the solenoid coil is energized to push the plunger 110 downwardly with a force sufficient to overcome the upward force of the spring 81. The plunger is held in this advanced position as long as the solenoid coil remains energized, and is returned to its normally raised position by the spring 81 as soon as the solenoid is de-energized.

Solenoids $S_N$ and $S_Q$ control the bridges 90 and 100 in the same manner described above in connection with the bridge 80 and the solenoid $S_D$. As the coins move along the wall 31 of the referencing recess 30, the outer edges of all coin denominations are at the same radial position at any given angular location along the edge. Consequently, the inner edges of coins of different denominations are offset from each other at any given angular location, due to the different diameters of the coins (see FIG. 2). These offset inner edges of the coins are used to separately count each coin before it leaves the referencing recess 30.

As can be seen in FIGS. 2 and 10–12, three coin sensors $S_1$, $S_2$ and $S_3$ in the form of insulated electrical contact pins are mounted in the upper surface of the recess 30. The outermost sensor $S_1$ is positioned so that it is contacted by all three coin denominations, the middle sensor $S_2$ is positioned so that it is contacted only by the nickels and quarters, and the innermost sensor $S_3$ is positioned so that it is contacted only by the quarters. An electrical voltage is applied to each sensor so that when a coin contacts the pin and bridges across its insulation, the voltage source is connected to ground via the coin and the metal head surrounding the insulated sensor. The grounding of the sensor during the time interval when it is contacted by the coin generates an electrical pulse which is detected by a counting system connected to the sensor. The pulses produced by coins contacting the three sensors $S_1$, $S_2$ and $S_3$ will be referred to herein as pulses $P_1$, $P_2$ and $P_3$, respectively, and the accumulated counts of those pulses in the counting system will be referred to as counts $C_1$, $C_2$ and $C_3$, respectively.

As a coin traverses one of the sensors, intermittent contact can occur between the coin and the sensor because of the contour of the coin surface. Consequently, the output signal from the sensor can consist of a series of short pulses rather than a single wide pulse, which is a common problem referred to as "contact bounce." This problem can be overcome by simply detecting the first pulse and then ignoring subsequent pulses during the time interval required for one coin to cross the sensor. Thus, only one pulse is detected for each coin that contacts the sensor.

The outer sensor $S_1$ contacts all three coin denominations, so the actual dime count $C_D$ is determined by subtracting $C_2$ (the combined quarter and nickel count) from $C_1$ (the combined count of quarters, nickels and dimes). The middle sensor $S_2$, contacts both the quarters and the nickels, so the actual nickel count $C_N$ is determined by subtracting $C_3$ (the quarter count) from $C_2$ (the combined quarter and nickel count). Because the innermost sensor $S_3$ contacts only quarters, the count $C_3$ is the actual quarter count $C_Q$.

Another counting technique uses the combination of (1) the presence of a pulse $P_1$ from the sensor $S_1$ and (2) the absence of a pulse $P_2$ from the sensor $S_2$ to detect the presence of a dime. A nickel is detected by the combination of (1) the presence of a pulse $P_2$ from the sensor $S_2$ and (2) the absence of a pulse $P_3$ from sensor $S_3$, and a quarter is detected by the presence of a pulse $P_3$ from the sensor $S_3$. The presence or absence of the respective pulses can be detected by a simple logic routine which can be executed by either hardware or software.

To permit the simultaneous counting of prescribed batches of coins of each denomination using the first counting technique described above, i.e., the subtraction algorithm, counts $C_2$ and $C_3$ must be simultaneously accumulated over two different time periods. For example, count $C_3$ is the actual quarter count $C_Q$, which normally has its own operator-selected limit $C_{QMAX}$. While the quarter count $C_Q$ ($=C_3$) is accumulating toward its own limit $C_{QMAX}$, however, the nickel count $C_N$ ($=C_2-C_3$) might reach its limit $C_{NMAX}$ and be reset to zero to start the counting of another batch of nickels. For accurate computation of $C_N$ following its reset to zero, the count $C_3$ must also be reset at the same time. The count $C_3$, however, is still needed for the ongoing count of quarters; thus the pulses $P_3$ are supplied to a second counter $C_3'$ which counts the same pulses $P_3$ that are counted by the first counter $C_3$ but is reset each time the counter $C_2$ is reset. Thus, the two counters $C_3$ and $C_3'$ a count the same pulses $P_3$, but can be reset to zero at different times.

The same problem addressed above also exists when the count $C_1$ is reset to zero, which occurs each time the dime count $C_D$ reaches its limit $C_{MAX}$. That is, the count $C_2$ is needed to compute both the dime count $C_D$ and the nickel count $C_N$, which are usually reset at different times. Thus, the pulses $P_2$ are supplied to two different counters $C_2$ and $C_2'$. The first counter $C_2$ is reset to zero only when the nickel count $C_N$ reaches its $C_{NMAX}$, and the second counter is reset to zero each time $C_1$ is reset to zero when $C_D$ reaches its limit $C_{DMAX}$.

Whenever one of the counts $C_D$, $C_N$ or $C_Q$ reaches its limit, a control signal is generated to initiate a bag-switching or bag-stop function.

For the bag-switching function, the control signal is used to actuate the movable shunt within the first of the two exit channels provided for the appropriate coin denomination. This enables the coin sorter to operate continuously (assuming that each full coin bag is replaced with an empty bag before the second bag for that same denomination is filled) because there is no need to stop the sorter either to remove full bags or to remove excess coins from the bags.

For a bag-stop function, the control signal preferably stops the drive for the rotating disc and at the same time actuates a brake for the disc. The disc drive can be stopped either by de-energizing the drive motor or by actuating a clutch which de-couples the drive motor from the disc. An alternative bag-stop system uses a movable diverter within a coin-recycling slot located between the counting sensors and the exit channels. Such a recycling diverter is described, for example, in U.S. Pat. No. 4,564,036 issued Jan. 14, 1986, for "Coin Sorting System With Controllable Stop."

Figure 19:
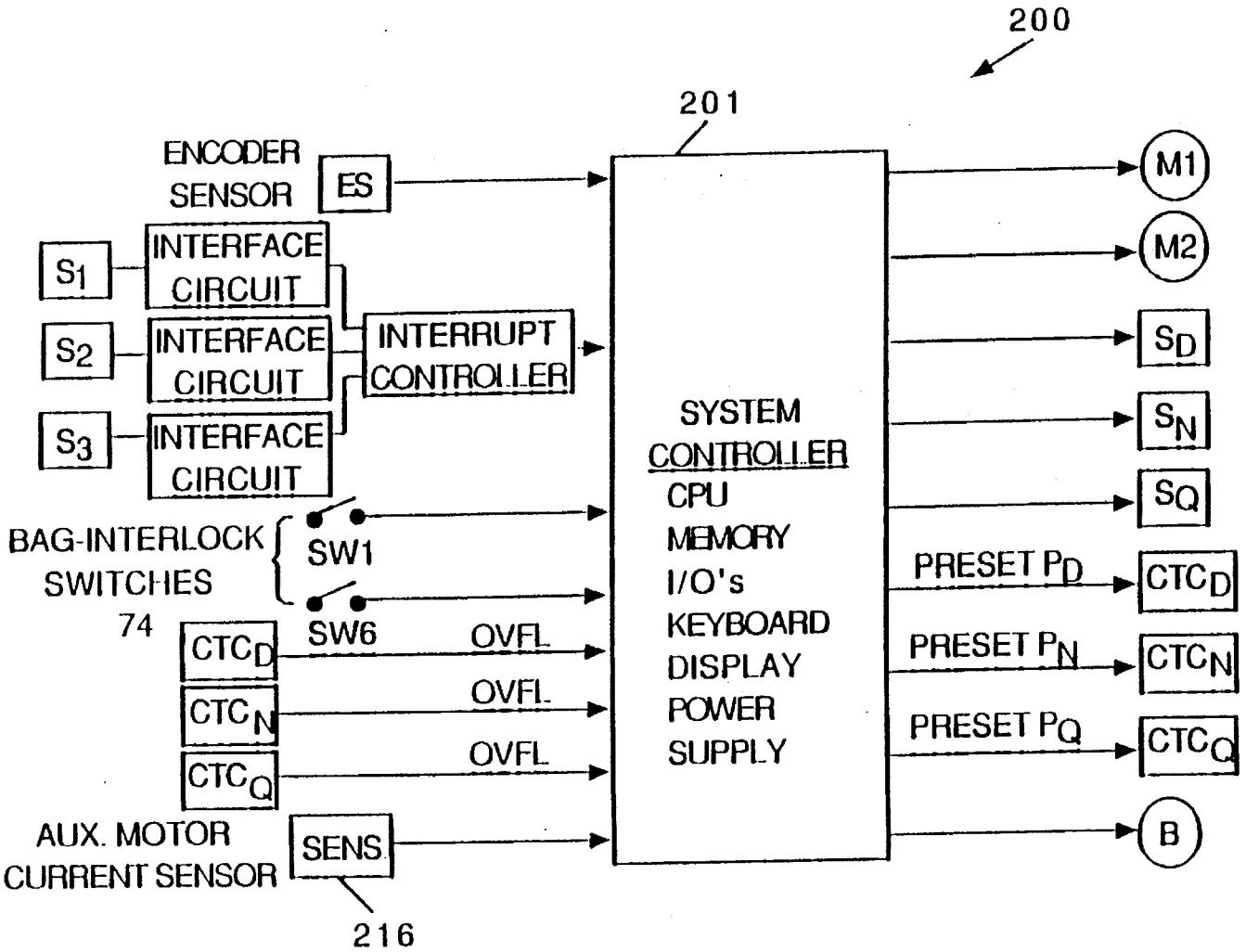
FIG. 19 is a block diagram of a microprocessor-based control system for use in the coin counting and sorting system of FIGS. 1–18.

Referring now to FIG. 19, there is shown an upper level block diagram of an illustrative microprocessor-based control system 200 for controlling the operation of a coin sorter incorporating the counting and sorting system of this invention. The control system 200 includes a central processor unit (CPU) 201 for monitoring and regulating the various parameters involved in the coin sorting/counting and bag-stopping and switching operations. The CPU 201 accepts signals from (1) the bag-interlock switches 74 which provide indications of the positions of the bag-clamping rings 72 which are used to secure coin bags B to the six coin guide tubes 51, to indicate whether or not a bag is available to receive each coin denomination, (2) the three coin sensors $S_1$ $-S_3$, (3) an encoder sensor $E_5$ and (4) three coin-tracking counters $CTC_D$, $CTC_N$ and $CTC_Q$. The CPU 201 produces output signals to control the three shunt solenoids $S_D$, $S_N$ and $S_Q$, the main drive motor $M_1$, an auxiliary drive motor $M_2$, a brake B and the three coin-tracking counters.

Figure 16:
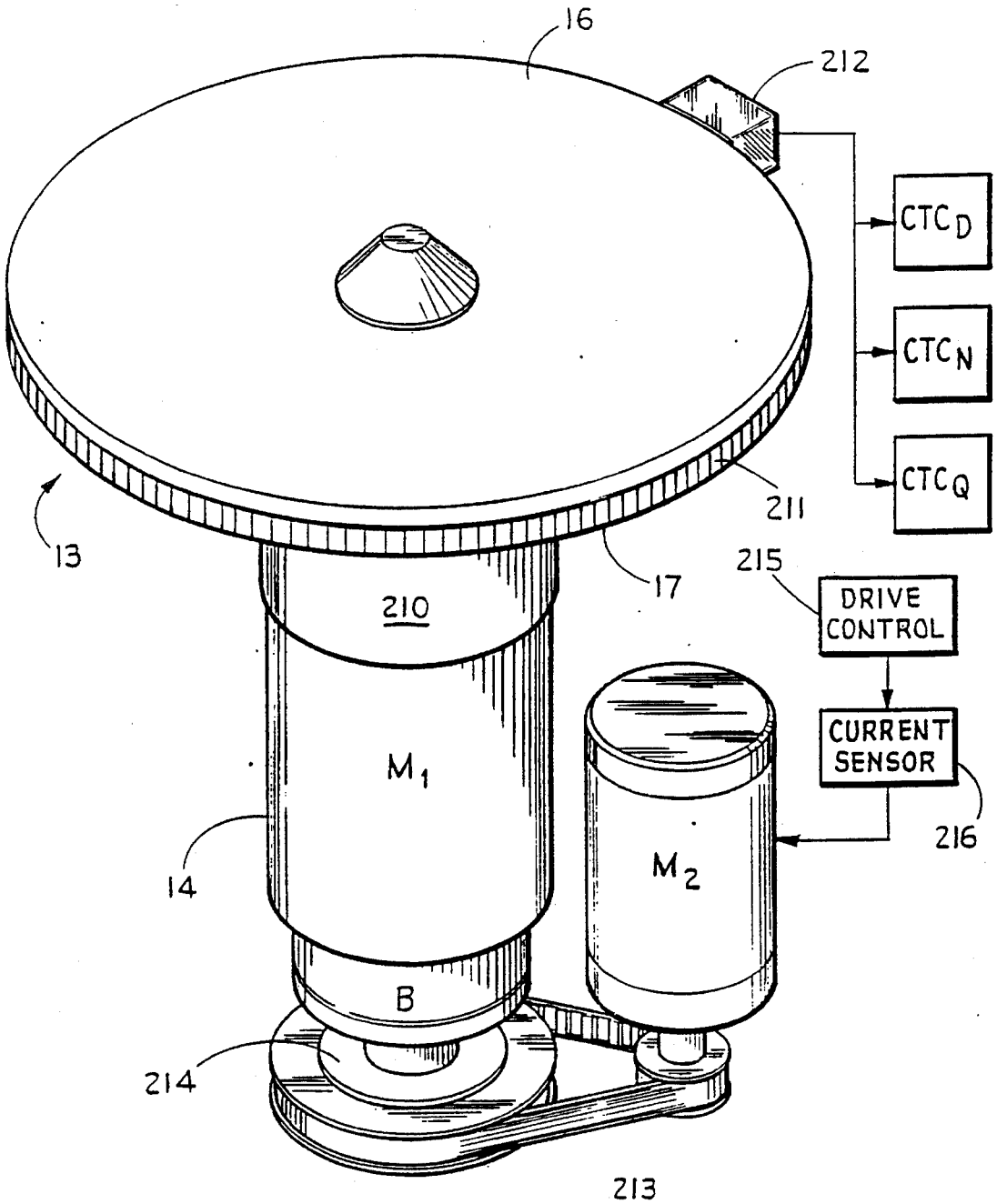
FIG. 16 is an enlarged perspective view of a preferred drive system for the rotatable disc in the system of FIG. 1.

A drive system for the rotating disc, for use in conjunction with the control system of FIG. 19, is illustrated in FIG. 16. The disc is normally driven by a main a-c. drive motor $M_1$ which is coupled directly to the coin-carrying disc 13 through a speed reducer 210. To stop the disc 13, a brake B is actuated at the same time the main motor $M_1$ is de-energized. To permit precise monitoring of the angular movement of the disc 13, the outer peripheral surface of the disc carries an encoder in the form of a large number of uniformly spaced indicia 211 (either optical or magnetic) which can be sensed by an encoder sensor 212. In the particular example illustrated, the disc has 720 indicia 211 so that the sensor 212 produces an output pulse for every 0.5° of movement of the disc 13.

The pulses from the encoder sensor 212 are supplied to the three coin-tracking down counters $CTD_D$, $CTC_N$ and $CTC_Q$ for separately monitoring the movement of each of the three coin denominations between fixed points on the sorting head. The outputs of these three counters $CTC_D$, $CTC_N$ and $CTC_Q$ can then be used to separately control the actuation of the bag-switching bridges 80, 90 and 100 and/or the drive system. For example, when the last dime in a prescribed batch has been detected by the sensors $S_1$–$S_3$, the dime-tracking counter $CTC_D$ is preset to count the movement of a predetermined number of the indicia 211 on the disc periphery past the encoder sensor 212. This is a way of measuring the movement of the last dime through an angular displacement that brings that last dime to a position where the bag-switching bridge 80 should be actuated to interpose the bridge between the last dime and the next successive dime.

In the sorting head of FIG. 2, a dime must traverse an angle of 20° to move from the position where it has just cleared the last counting sensor $S_1$ to the position where it has just cleared the bag-switching bridge 80. At a disc speed of 250 rpm, the disc turns—and the coin moves—at a rate of 1.5° per millisecond. A typical response time for the solenoid that moves the bridge 80 is 6 milliseconds (4 degrees of disc movement), so the control signal to actuate the solenoid should be transmitted when the last dime is 4 degrees from its bridge-clearing position. In the case where the encoder has 720 indicia around the circumference of the disc, the encoder sensor produces a pulse for ever 0.5° of disc movement. Thus the coin-tracking counter $CTC_D$ for the dime is preset to 32 when the last dime is sensed, so that the counter $CTC_D$ counts down to zero, and generates the required control signal, when the dime has advanced 16° beyond the last sensor $S_1$. This ensures that the bridge 80 will be moved just after it has been cleared by the last dime, so that the bridge 80 will be interposed between that last dime and the next successive dime.

In order to expand the time interval available for any of the bag-switching bridges to be interposed between the last coin in a prescribed batch and the next successive coin of that same denomination, control means may be provided for reducing the speed of the rotating disc 13 as the last coin in a prescribed batch is approaching the bridge. Reducing the speed of the rotating disc in this brief time interval has little effect on the overall throughput of the system, and yet it significantly increases the time interval available between the instant when the trailing edge of the last coin clears the bridge and the instant when the leading edge of the next successive coin reaches the bridge. Consequently, the timing of the interposing movement of the bridge relative to the coin flow past the bridge becomes less critical and, therefore, it becomes easier to implement and more reliable in operation.

Reducing the speed of the rotating disc is preferably accomplished by reducing the speed of the motor which drives the disc. Alternatively, this speed reduction can be achieved by actuation of a brake for the rotating disc, or by a combination of brake actuation and speed reduction of the drive motor.

One example of a drive system for controllably reducing the speed of the disc 13 is illustrated in FIG. 16. This system includes an auxiliary d-c. motor $M_2$ connected to the drive shaft of the main drive motor $M_1$ through a timing belt 213 and an overrun clutch 214. The speed of the auxiliary motor $M_2$ is controlled by a drive control circuit 215 through a current sensor 216 which continuously monitors the armature current supplied to the auxiliary motor $M_2$. When the main drive motor $M_1$ is de-energized, the auxiliary d-c. motor $M_2$ can be quickly accelerated to its normal speed while the main motor $M_1$ is decelerating. The output shaft of the auxiliary motor turns a gear which is connected to a larger gear through the timing belt 213, thereby forming a speed reducer for the output of the auxiliary motor $M_2$. The overrun clutch 214 is engaged only when the auxiliary motor $M_2$ is energized, and serves to prevent the rotational speed of the disc 13 from decreasing below a predetermined level while the disc is being driven by the auxiliary motor.

Returning to FIG. 19, when the prescribed number of coins of a prescribed denomination has been counted for a given coin batch, the controller 201 produces control signals which energize the brake B and the auxiliary motor $M_2$ and de-energize the main motor $M_1$. The auxiliary motor $M_2$ rapidly accelerates to its normal speed, while the main motor $M_1$ decelerates. When the speed of the main motor is reduced to the speed of the overrun clutch 214 driven by the auxiliary motor, the brake overrides the output of the auxiliary motor, thereby causing the armature current of the auxiliary motor to increase rapidly. When this armature current exceeds a preset level, it initiates de-actuation of the brake, which is then disengaged after a short time delay. After the brake is disengaged, the armature current of the auxiliary motor drops rapidly to a normal level needed to sustain the normal speed of the auxiliary motor. The disc then continues to be driven by the auxiliary motor alone, at a reduced rotational speed, until the encoder sensor 212 indicates that the last coin in the batch has passed the position where that coin has cleared the bag-switching bridge in the first exit slot for that particular denomination. At this point the main drive motor is re-energized, and the auxiliary motor is de-energized.

Figure 20A:
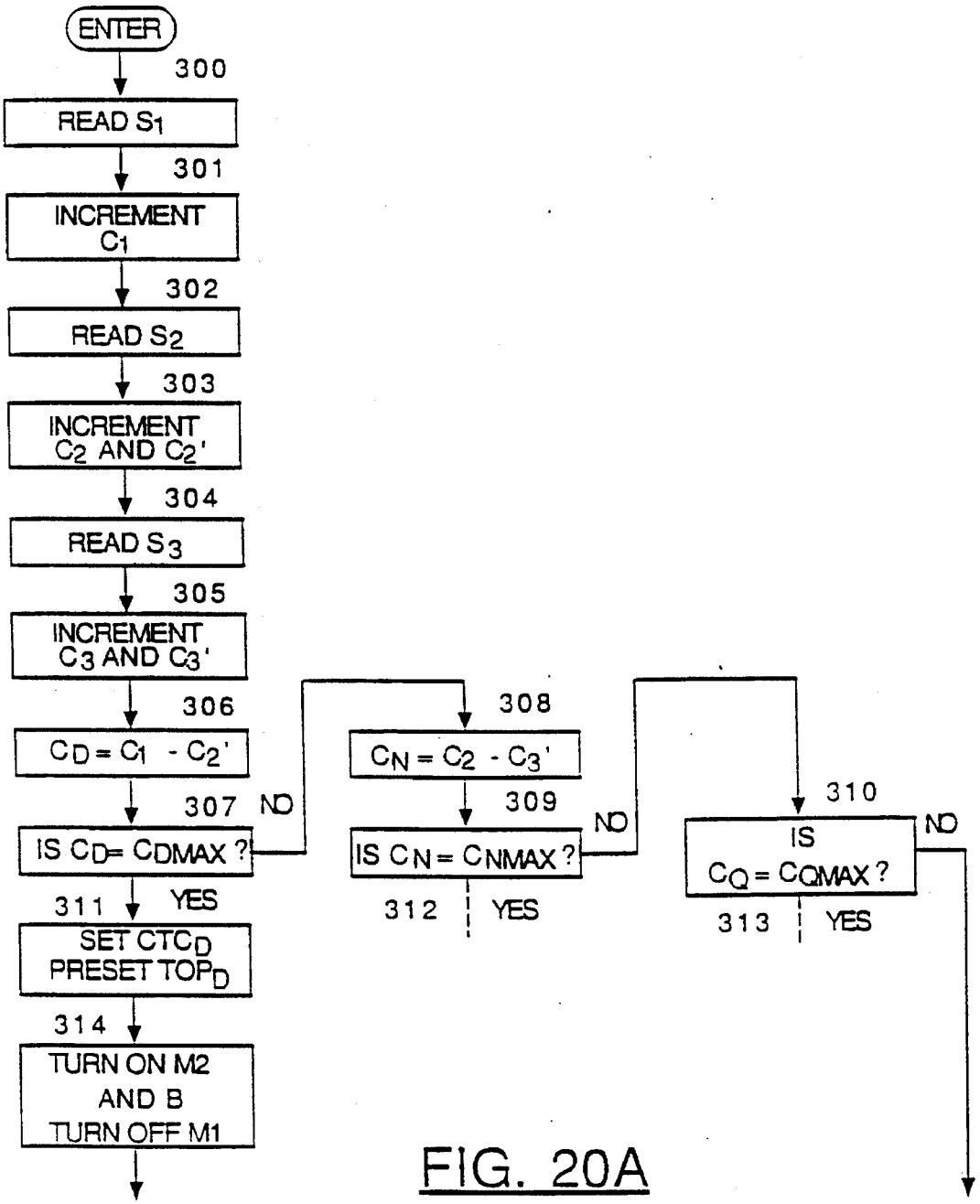
FIGS. 20A and 20B, combined, form a flow chart of a portion of a program for controlling the operation of the microprocessor included in the control system of FIG. 19.
Figure 20B:
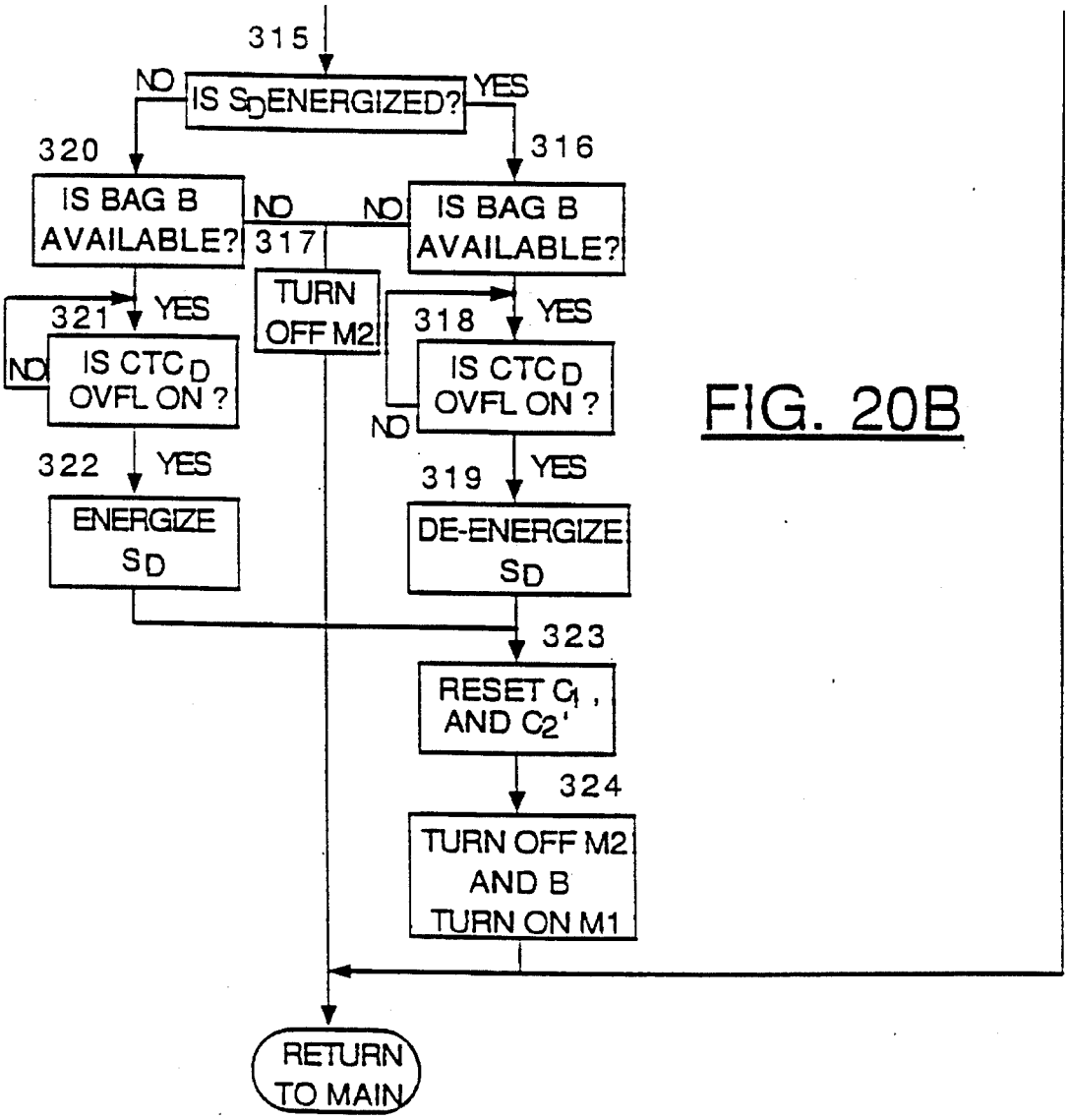

Referring now to FIG. 20, there is shown a flow chart 220 illustrating the sequence of operations involved in utilizing the bag-switching system of the illustrative sorter of FIG. 1 in conjunction with the microprocessor-based system discussed above with respect to FIG. 19.

The subroutine illustrated in FIG. 20 is executed multiple times in every millisecond. Any given coin moves past the coin sensors at a rate of about 1.5° per millisecond. Thus, several milliseconds are required for each coin to traverse the sensors, and so the subroutine of FIG. 20 is executed several times during the sensor-traversing movement of each coin.

The first six steps 300–305 in the subroutine of FIG. 20 determine whether the interrupt controller has received any pulses from the three sensors $S_1$–$S_3$. If the answer is affirmative for any of the three sensors, the corresponding count $C_1$, $C_2$, $C_2'$, $C_3$ and $C_3'$ is incremented by one. Then at step 306 the actual dime count $C_D$ is computed by subtracting count $C_2'$ from $C_1$. The resulting value $C_D$ is then compared with the current selected limit value $C_{DMAX}$ at step 307 to determine whether the selected number of dimes has passed the sensors. If the answer is negative, the subroutine advances to step 308 where the actual nickel count $C_N$ is computed by subtracting count $C_3'$ from $C_2$. The resulting value $C_N$ is then compared with the determine whether the selected number of nickels has passed the sensors. A negative answer at step 309 advances the program to step 310 where the quarter count $C_Q$ (=$C_3$) is compared with $C_{DMAX}$ to determine whether the selected number of quarters has been counted.

When one of the actual counts $C_D$, $C_N$ or $C_Q$ reaches the corresponding limit $C_{DMAX}$, $C_{NMAX}$ or $C_{QMAC}$, an affirmative answer is produced at step 311, 312 or 313.

An affirmative answer at step 311 indicates that the selected number of dimes has been counted, and thus the bridge 80 in the first exit slot 40 for the dime must be actuated so that it diverts all dimes following the last dime in the completed batch. To determine when the last dime has reached the predetermined position where it is desired to transmit the control signal that initiates actuation of the solenoid $S_D$, step 311 presets the coin-tracking counter $CTC_D$ to a value $P_D$. The counter $CTC_D$ then counts down from $P_D$ in response to successive pulses from the encoder sensor ES as the last dime is moved from the last sensor $S_3$ toward the bridge 80. To control the speed of the dime so that it is moving at a known constant speed during the time interval when the solenoid $S_D$ is being actuated, step 314 turns off the main drive motor M1 and turns on the auxiliary d-c. drive motor M2 and the brake B. This initiates the sequence of operations described above, in which the brake B is engaged while the main drive motor M1 is decelerating and then disengaged while the auxiliary motor M2 drives the disc 13 so that the last dime is moving at a controlled constant speed as it approaches and passes the bridge 80.

To determine whether the solenoid $S_D$ must be energized or de-energized, step 315 of the subroutine determines whether the solenoid $S_D$ is already energized. An affirmative response at step 315 indicates that it is bag B that contains the preset number of coins, and thus the system proceeds to step 316 to determine whether bag A is available. If the answer is negative, indicating that bag B is not available, then there is no bag available for receiving dimes and the sorter must be stopped. Accordingly, the system proceeds to step 317 where the auxiliary motor M2 is turned off and the brake B is turned on to stop the disc 13 after the last dime is discharged into bag B. The sorter cannot be re-started again until the bag-interlock switches for the dime bags indicate that the full bag has been removed and replaced with an empty bag.

An affirmative answer at step 316 indicates that bag A is available, and thus the system proceeds to step 318 to determine whether the coin-tracking counter $CTC_D$ has reached zero, i.e., whether the $OVFL_D$ signal is on. The system reiterates this query until $OVFL_D$ is on, and then advances to step 319 to generate a control signal to de-energize the solenoid $S_D$ so that the bridge 80 is moved to its retracted (upper) position. This causes all the dimes for the next coin batch to enter the first exit channel 40 so that they are discharged into bag A.

A negative answer at step 315 indicates the full bag is bag A rather than bag B, and thus the system proceeds to step 320 to determine whether bag B is available. If the answer is negative, it means that neither bag A nor bag B is available to receive the dimes, and thus the sorter is stopped by advancing to step 317. An affirmative answer at step 320 indicates that bag B is, in fact, available, and thus the system proceeds to step 321 to determine when the solenoid $S_n$ is to be energized, in the same manner described above for step 318. Energizing the solenoid $S_D$ causes the bridge 80 to be advanced to its lower position so that all the dimes for the next batch are shunted past the first exit channel 40 to the second exit channel 41. The control signal for energizing the solenoid is generated at step 321 when step 320 detects that $OVFL_D$ is on.

Each time the solenoid $S_n$ is either energized at step 322 or de-energized at step 319, the subroutine resets the counters $C_1$ and $C_2'$ at step 323, and turns off the auxiliary motor M2 and the brake B and turns on the main drive motor M1 at step 324. This initializes the dime-counting portion of the system to begin the counting of a new batch of dimes.

It can thus be seen that the sorter can continue to operate without interruption, as long as each full bag of coins is removed and replaced with an empty bag before the second bag receiving the same denomination of coins has been filled. The exemplary sorter is intended for handling coin mixtures of only dimes, nickels and quarters, but it will be recognized that the arrangement described for these three coins in the illustrative embodiment could be modified for any other desired coin denominations, depending upon the coin denominations in the particular coin mixtures to be handled by the sorter.

Figure 21:
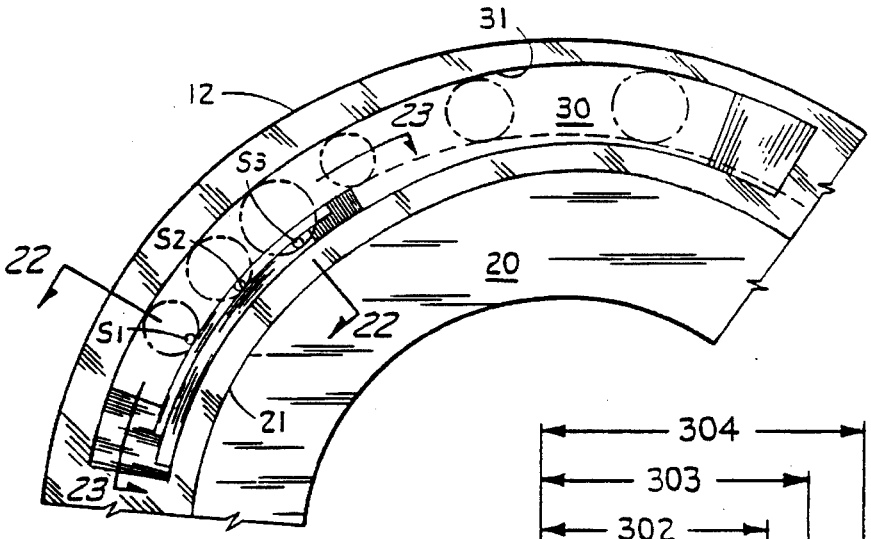
Figure 22:
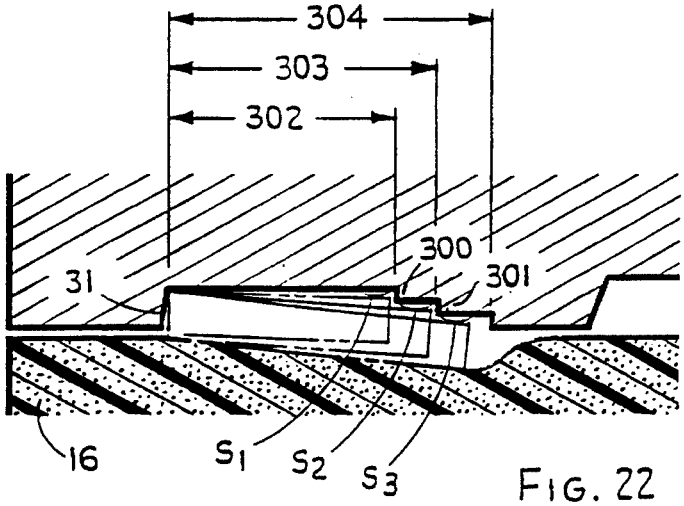
FIG. 22 is an enlarged section taken generally along line 22—22 in FIG. 21.
Figure 23:
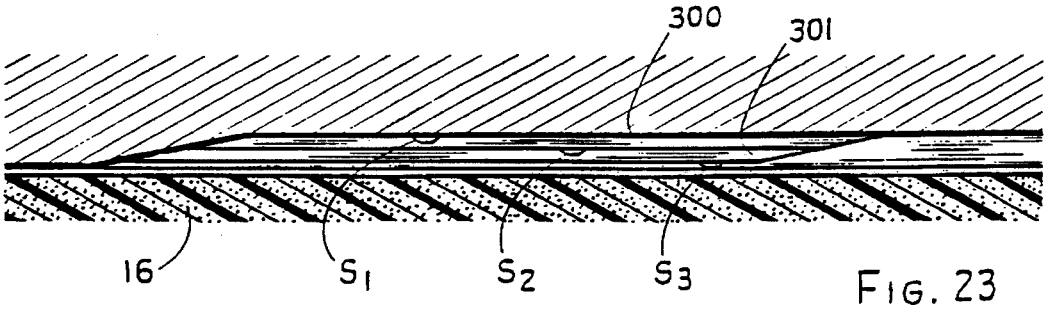
FIG. 23 is an enlarged section taken generally along line 23—23 in FIG. 21.
Figure 24:
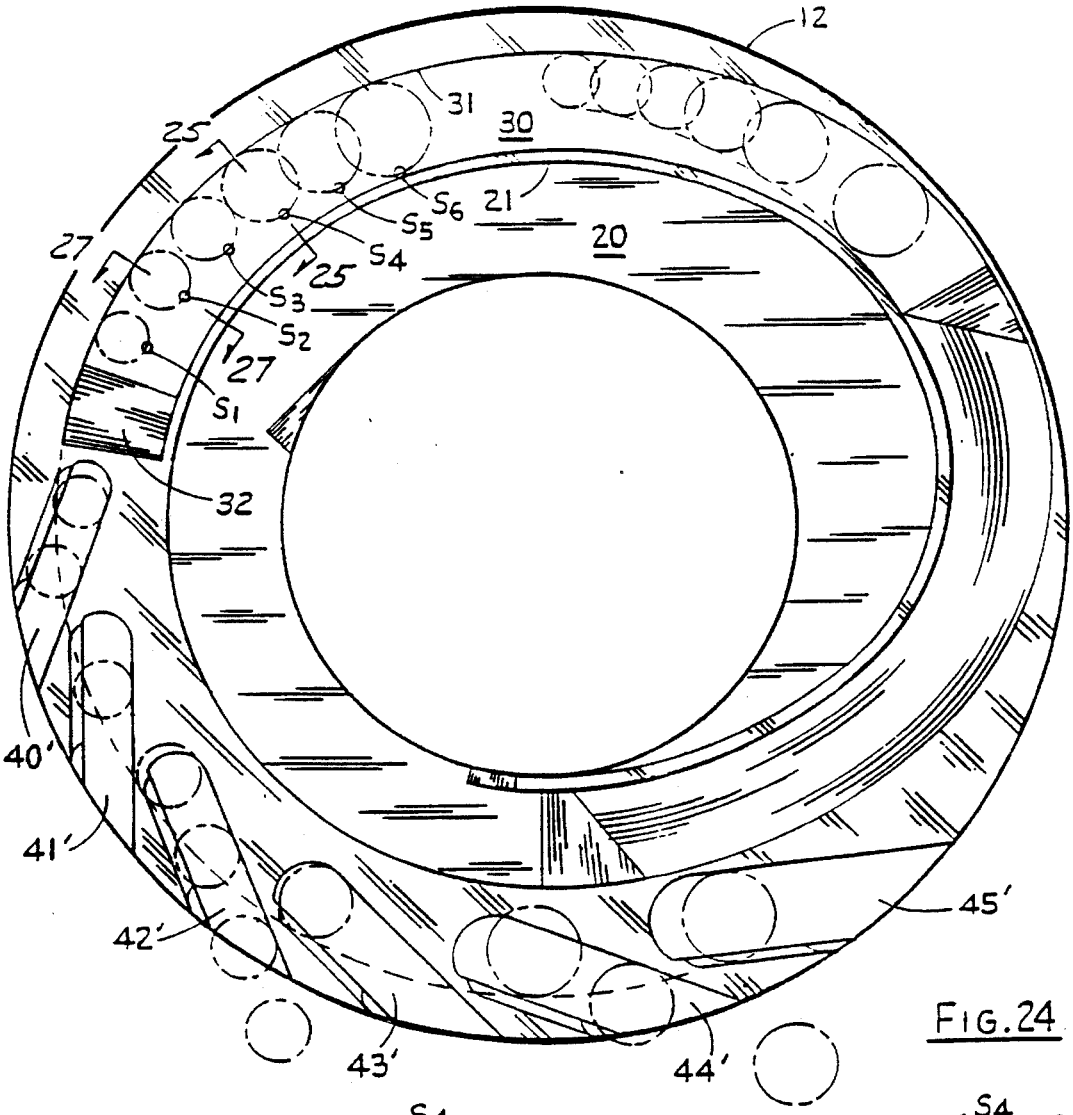
FIG. 24 is a bottom plan view of another modified sorting head for use in the coin counting and sorting system of FIG. 1, and embodying the present invention.

An alternative coin-sensor arrangement is illustrated in FIGS. 21–23. In this arrangement that portion of the top surface of the referencing recess 30 that contains the counting sensors $S_1$–$S_3$ is stepped so that each sensor is offset from the other two sensors in the axial (vertical) direction as well as the radial (horizontal) direction. Thus, the steps 300 and 301 form three coin channels 302, 303 and 304 of different widths and depths. Specifically, the deepest channel 302 is also the narrowest channel, so that it can receive only dimes; the middle channel 303 is wide enough to receive nickels but not quarters; and the shallowest channel 304 is wide enough to receive quarters. The top surfaces of all three channels 302–304 are close enough to the pad 16 to press all three coin denominations into the pad.

The three counting sensors $S_1$ , $S_2$ and $S_3$ are located within the respective channels 302, 202 and 304 so that each sensor is engaged by only one denomination of coin. For example, the sensor $S_1$ engages the dimes in the channel 302, but cannot be reached by nickels or quarters because the channel 302 is too narrow to receive coins larger than dimes. Similarly, the sensor $S_2$ is spaced radially inwardly from the inner edges of the dimes so that it engages only nickels in the channel 303. The sensor $S_3$ engages quarters in the channel 304, but is spaced radially inwardly from both the nickels and the dimes.

It will be appreciated from the foregoing description of the sensor arrangement of FIGS. 21–23 that this arrangement permits direct counting of the various coin denominations, without using the subtraction algorithm or the pulseprocessing logic described above in connection with the embodiment of FIGS. 2–15.

FIGS. 24–28 show another modification of the sorting head of FIGS. 2–15 to permit the counting and sorting of coins of six different denominations, without automatic bag switching. This sorting head has six different exit channels 40'–45', one for each of six different denominations, rather than a pair of exit channels for each denomination.

Figure 25:
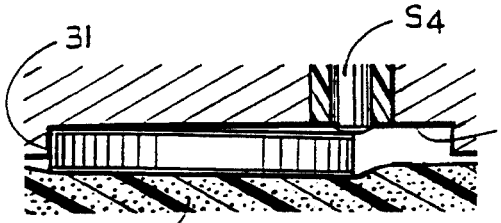
FIG. 25 is an enlarged section taken generally along line 25—25 in FIG. 24.
Figure 26:
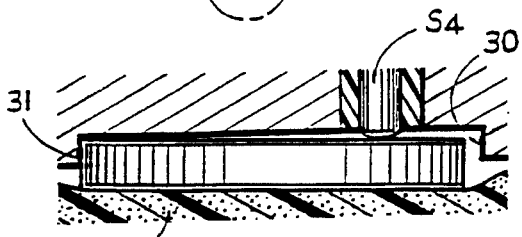
FIG. 26 is the same section shown in FIG. 25 with a larger diameter coin in place of the coin shown in FIGS. 24 and 25.
Figure 27:
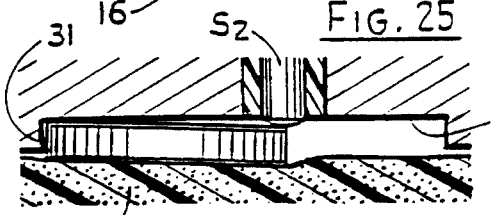
FIG. 27 is an enlarged section taken generally along line 27—27 in FIG. 24.
Figure 28:
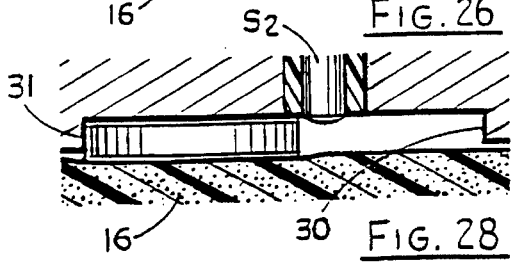
FIG. 28 is the same section shown in FIG. 27 with a smaller diameter coin in place of the coin shown in FIGS. 24 and 27.

In the counting system of FIGS. 24–28, the six sensors $S_1$–$S_6$ are spaced apart from each other in the radial direction so that one of the sensors is engaged only by half dollars, and each of the other sensors is engaged by a different combination of coin denominations. For example, as illustrated in FIGS. 25 and 26, the sensor $S_4$, engages not only quarters (FIG. 25) but also all larger coins (FIG. 26), while missing all coins smaller than the sensor $S_2$ engaging a penny (FIG. 27) but missing a dime (FIG. 28).

The entire array of sensors produces a unique combination of signals for each different coin denomination, as illustrated by the following table where a "1" represents engagement with the sensor and a "0" represents non-engagement with the sensor:

| | $P_1$ | $P_2$ | $P_3$ | $P_4$ | $P_5$ | $P_6$ |
|---|---|---|---|---|---|---|
| 10¢ | 1 | 0 | 0 | 0 | 0 | 0 |
| 1¢ | 1 | 1 | 0 | 0 | 0 | 0 |
| 5¢ | 1 | 1 | 1 | 0 | 0 | 0 |
| 25¢ | 1 | 1 | 1 | 1 | 0 | 0 |
| $1 | 1 | 1 | 1 | 1 | 1 | 0 |
| 50¢ | 1 | 1 | 1 | 1 | 1 | 1 |

by analyzing the combination of signals produced by the six sensors $S_1$–$S_6$ in response to the passage of any coin thereover, the denomination of that coin is determined immediately, and the actual count for that denomination can be incremented directly without the use of any subtraction algorithm. Also, this sensor arrangement minimizes the area of the sector that must be dedicated to the sensors on the lower surface of the sorting head. The analysis of the signals produced by the six sensors $S_1$–$S_6$ in response to any given coin can be simplified by detecting only that portion of each combination of signals that is unique to one denomination of coin. As can be seen from the above table, these unique portions are $P_1$=0 and $P_2$=1 for the dime, $P_2$=0 and $P_3$=1 for the penny, $P_3$=0 and $P^4$ =1 for the nickel, $P_4$=0 and $P_5$=1 for the quarter, $P_5$=0 and $P_6$=1 for the dollar, and $P_6$=1 for the half dollar. As an alterative to the signal-processing system described above, the counts $C_1$–$C_6$ of the pulses $P_1$–$P_6$ from the six sensors $S_1$–$S_6$ in FIGS. 24–28 may be processed as follows to yield actual counts $C_D$, $C_P$, $C_N$, $C_Q$, $C_S$ and $C_H$ of dimes, pennies, nickels, quarters, dollars and half dollars:

$$C_D=C_1-C_2$$

$$C_P=C_2-C_3$$

$$C_N=C_3-C_4$$

$$C_Q=C_4-C_5$$

$$C_S=C_5-C_6$$

$$C_H=C_6$$

Figure 29:
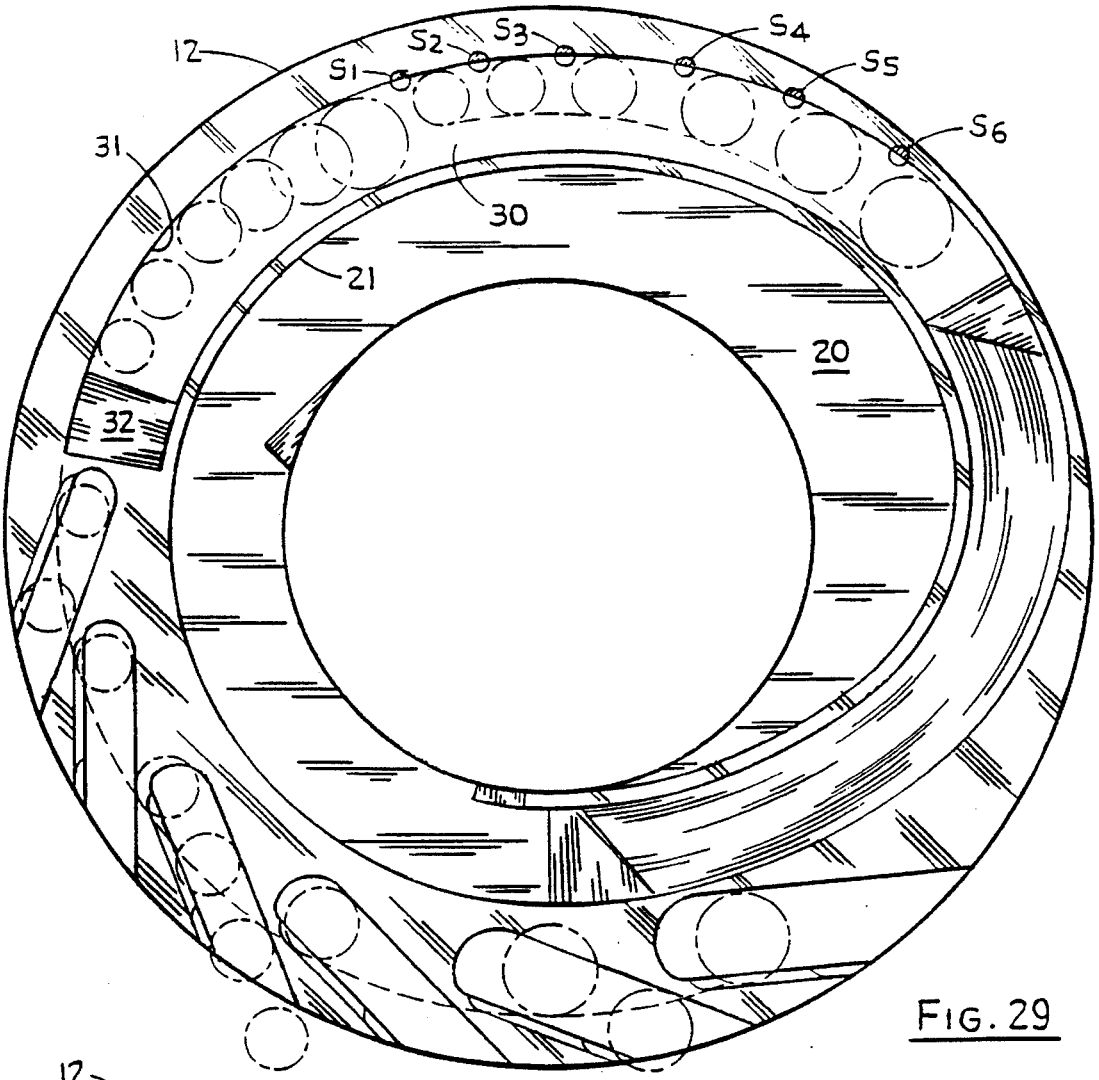
FIG. 29 is a bottom plan view of another modified sorting head for use in the coin counting and sorting system of FIG. 1, and embodying the present invention of FIG. 24.
Figure 30:
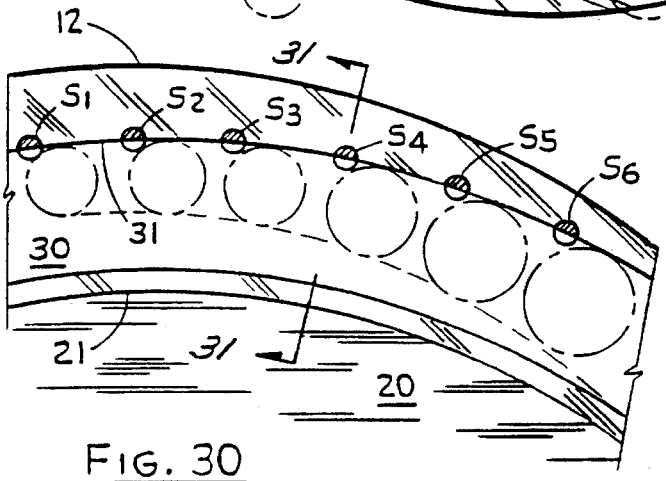
FIG. 30 is an enlargement of the upper right-hand portion of FIG. 29.
Figure 31:
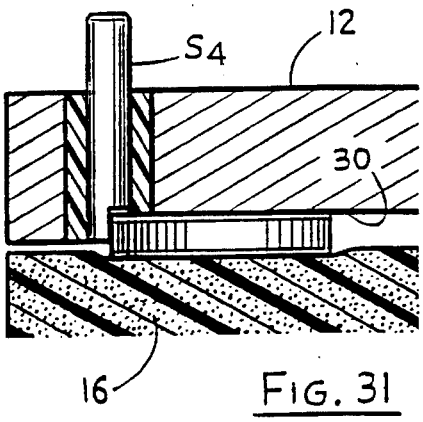
FIG. 31 is a section taken generally along line 31—31 in FIG. 30.

FIGS. 29–31 illustrate a six-denomination sorting head using yet another coin-sensor arrangement. In this arrangement the sensors $S_1$–$S_6$ are located at the upstream end of the referencing recess 30, in the outer wall 31 of that recess. Because the coins leave the outwardly spiralling channel 25 with the inner edges of all coin denominations at a common radius, the outer edges of the coins are offset from each other according to the diameters (denominations) of the coins. Consequently, coins of different denominations engage the inwardly spiralling wall 31 at different circumferential positions, and the six sensors $S_1$–$S_6$ are located at different circumferential positions so that each sensor is engaged by a different combination of denominations.

The end result of the sensor arrangement of FIGS. 29–31 is the same as that of the sensor arrangement of FIGS. 24–28. That is, the sensor $S_1$ is engaged by six denominations, sensor $S_2$ is engaged by five denominations, sensor $S_3$ is engaged by four denominations, sensor $S_4$ is engaged by three denominations,s sensor $S_5$ is engaged by two denominations, and sensor $S_6$ is engaged by only one denomination. The counts $C_1$–$C_6$ of the pulses $P_1$–$P_6$ from the six sensors $S_1$–$S_6$ may be processed in the same manner described above for FIGS. 24–28 to yield actual counts $C_D$, $C_P$, $C_N$, $C_Q$, $C_S$ and $C_H$.

As shown in FIG. 31, the sensors used in the embodiment of FIGS. 29–31 may be formed as integral parts of the outer wall 31 of the recess 30. Thus, the insulated contact pins may be installed in the metal plate used to form the sorting head before the various contours are formed by machining the surface of the plate. Then when the recess 30 is formed in the plate, the cutting tool simply cuts through a portion of each contact pin just as though it were part of the plate.

Figure 32:
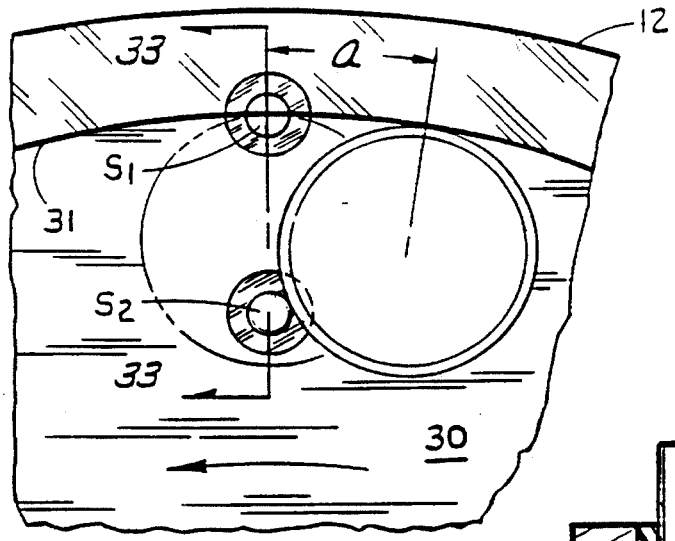
FIG. 32 is a fragmentary bottom plan view of a modified coin-counting area for the sorting head of FIG. 29.
Figure 33:
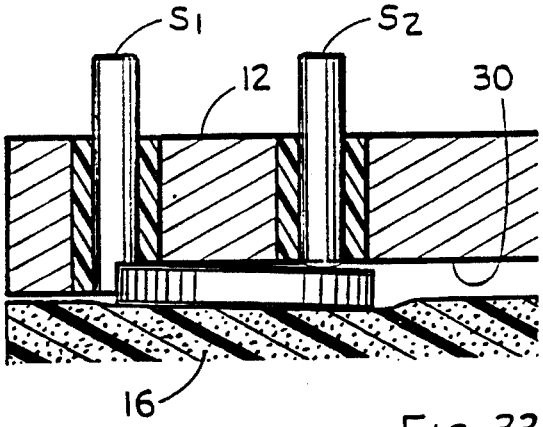
FIG. 33 is a section taken generally along line 33—33 in FIG. 32.

Still another coin sensor arrangement is shown in FIGS. 32 and 33. In this arrangement only two sensors are used to detect all denominations. One of the sensors $S_1$, is located in the wall that guides the coins while they are being sensed, and the other sensor $S_2$is spaced radially away from the sensor $S_1$by a distance that is less than the diameter of the smallest coin to be sensed by $S_2$. Every coin engages both sensors $S_1$ and $S_2$, but the time interval between the instant of initial engagement with $S_2$ and the instant of initial engagement with $S_1$ varies according to the diameter of the coin. A large-diameter coin engages $S_2$ earlier (relative to the engagement with $S_1$) than a small-diameter coin. Thus, by measuring the time interval between the initial contacts with the two sensors $S_1$ and $S_2$ for any given coin, the diameter of that coin can be determined.

Alternatively, the encoder on the periphery of the disc 13 can be used to measure the angular displacement a of each coin from the time it initially contacts the sensor $S_1$ until it initially contacts the sensor $S_2$. This angular displacement a increases as the diameter of the coin increases; so the diameter of each coin can be determined from the magnitude of the measured angular displacement. This denomination-sensing technique is insensitive to variations in the rotational speed of the disc because it is based on the position of the coin, not its speed.

Figure 34:
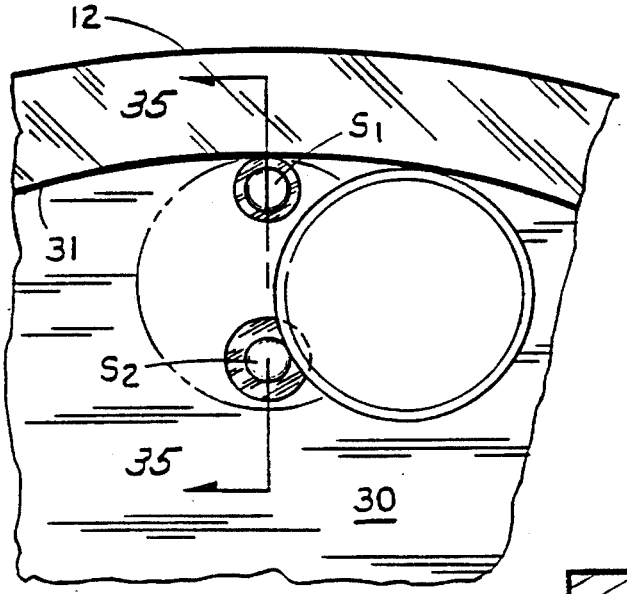
FIG. 34 is a fragmentary bottom plan view of still another modified coin-counting area for the sorting head of FIG. 29.
Figure 35:
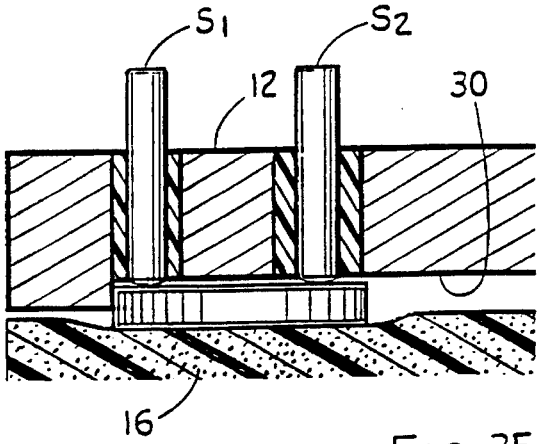
FIG. 35 is a section taken generally along line 35—35 in FIG. 34.

FIGS. 34 and 35 show a modified form of the two-sensor arrangement of FIGS. 32 and 33. In this case the sensor $S_1$ engages the fiat side of the coin rather than the edge of the coin. Otherwise the operation is the same.

Figure 36:
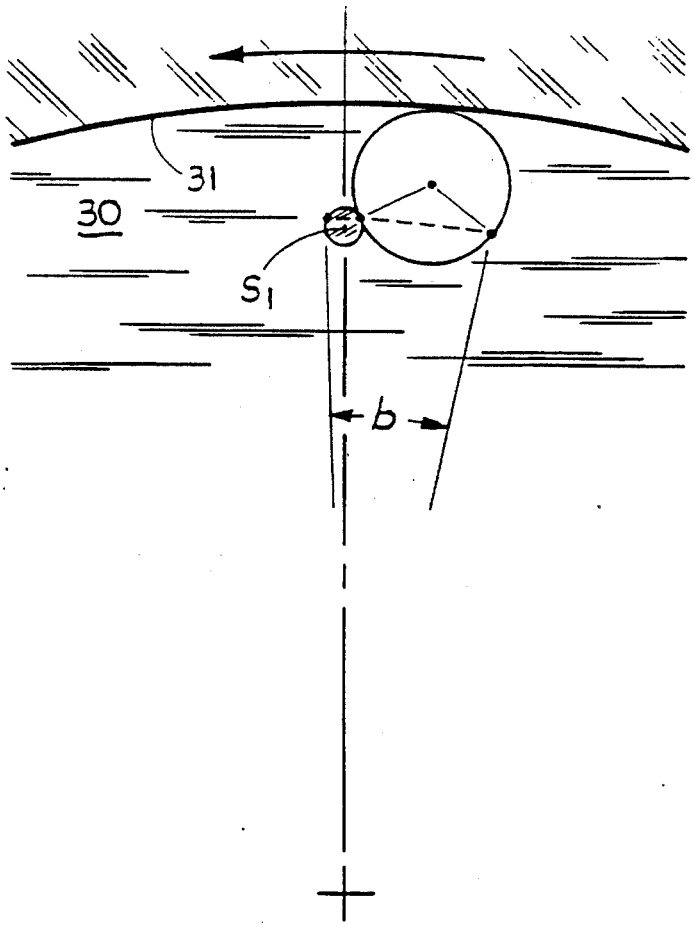
FIG. 36 is a fragmentary bottom plan view of yet another modified coin-counting area for the sorting head of FIG. 24.
Figure 37:
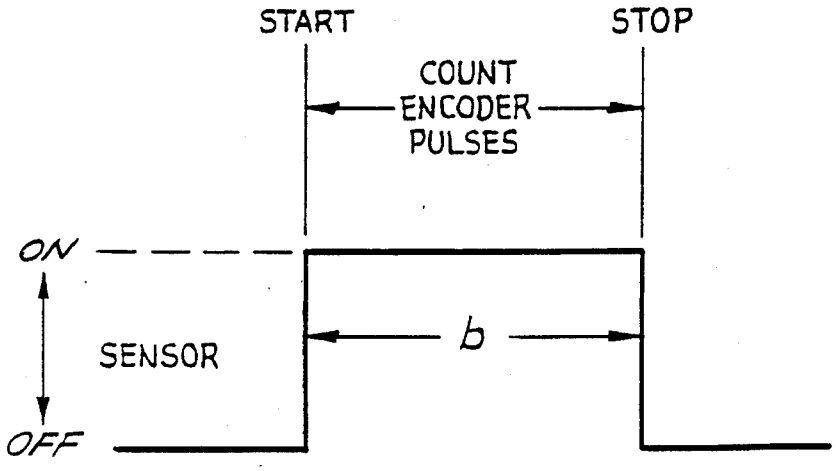
FIG. 37 is a timing diagram illustrating the operation of the counting area shown in FIG. 36.

Another modified counting arrangement is shown in FIG. 36. This arrangement uses a single sensor $S_1$ which is spaced away from the coin-guiding wall 31 by a distance that is less than the diameter of the smallest coin. Each coin denomination traverses the sensor $S_1$ over a unique range of angular displacement b, which can be accurately measured by the encoder on the periphery of the disc 13, as illustrated by the timing diagram in FIG. 37. The counting of pulses from the encoder sensor 212 is started when the leading edge of a coin first contacts the sensor $S_1$, and the counting is continued until the trailing edge of the coin clears the sensor. As mentioned previously, the sensor will not usually produce a uniform fiat pulse, but there is normally a detectable rise or fall in the sensor output signal when a coin first engages the sensor, and again when the coin clears the sensor. Because each coin denomination requires a unique angular displacement b to traverse the sensor, the number of encoder pulses generated during the sensor-traversing movement of the coin provides a direct indication of the size, and therefore the denomination, of the coin.

FIGS. 38–43 illustrate a system in which each coin is sensed after it has been sorted but before it has exited from the rotating disc. One of six proximity sensors $S_1$–$S_6$ is mounted along the outboard edge of each of the six exit channels 350–355 in the sorting head. By locating the sensors $S_1$–$S_6$ in the exit channels, each sensor is dedicated to one particular denomination of coin, and thus it is not necessary to process the sensor output signals to determine the coin denomination. The effective fields of the sensors $S_1$–$S_6$ are all located just outboard of the radius $R_g$ at which the outer edges of all coin denominations are gaged before they reach the exit channels 350–355, so that each sensor detects only the coins which enter its exit channel and does not detect the coins which bypass that exit channel. Thus, in FIG. 38 the circumferential path followed by the outer edges of all coins as they traverse the exit channels is illustrated by the dashed-line arc $R_g$. Only the largest coin denomination (e.g., U.S. half dollars) reaches the sixth exit channel 355, and thus the location of the sensor in this exit channel is not as critical as in the other exit channels 350–354.

Figure 38:
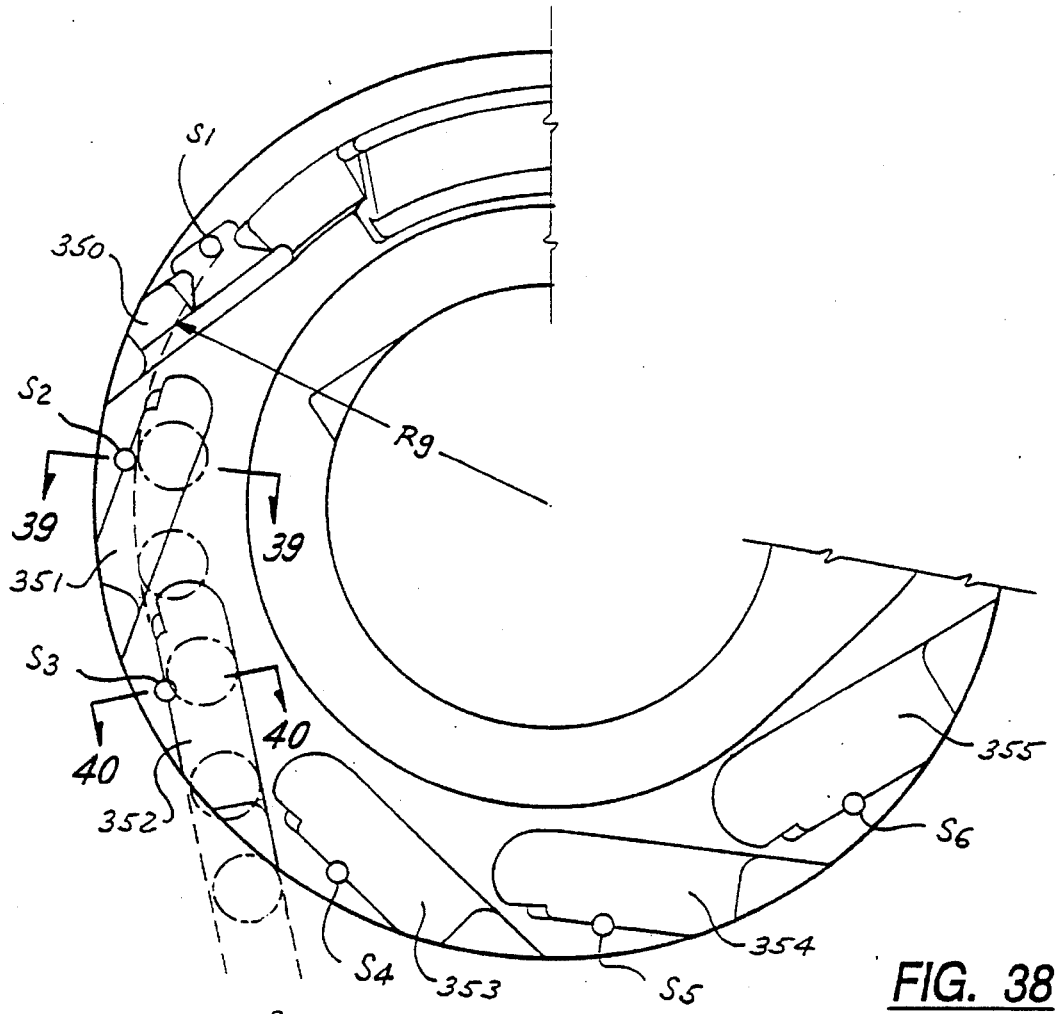
FIG. 38 is a bottom plan view of a further modified sorting head for use in the coin counting and sorting system of FIG. 1, and embodying the present invention.
Figure 39:
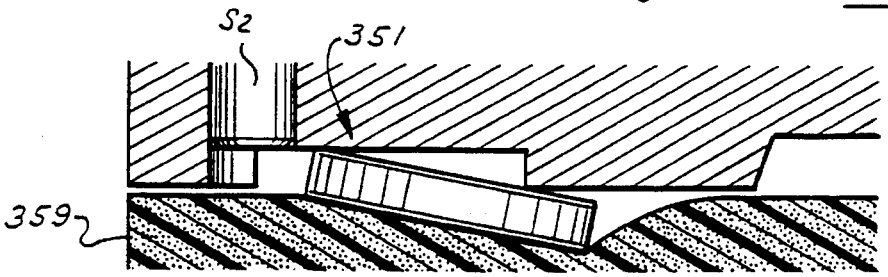
FIG. 39 is a section taken generally along line 39—39 in FIG. 38.
Figure 40:
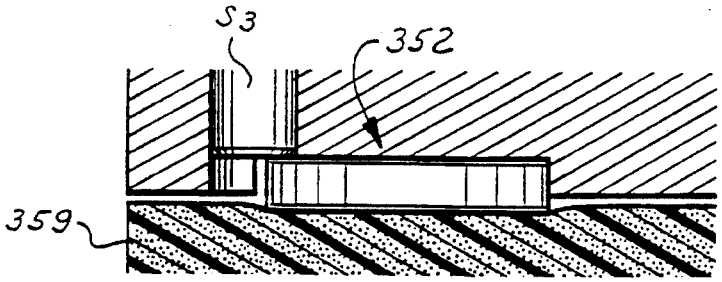
FIG. 40 is a section taken generally along line 40—40 in FIG. 38.

It is preferred that each exit channel have the straight side walls shown in FIG. 38, instead of the curved side walls used in the exit channels of many previous disc-type coin sorters. The straight side walls facilitate movement of coins through an exit slot during the jogging mode of operation of the drive motor, after the last coin has been sensed, which will be described in more detail below.

To ensure reliable monitoring of coin movement downstream of the respective sensors, as well as reliable sensing of each coin, each of the exit channels 350–355 is dimensioned to press the coins therein down into the resilient top surface of the rotating disc. This pressing action is a function of not only the depth of the exit channel, but also the clearance between the lowermost surface of the sorting head and the uppermost surface of the disc.

Figure 42:
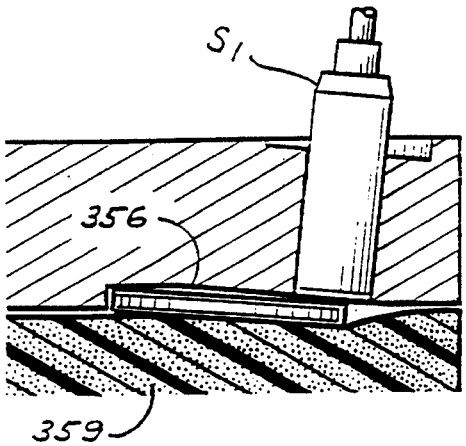
FIG. 42 is a section taken generally along line 42—42 in FIG. 41.
Figure 43:
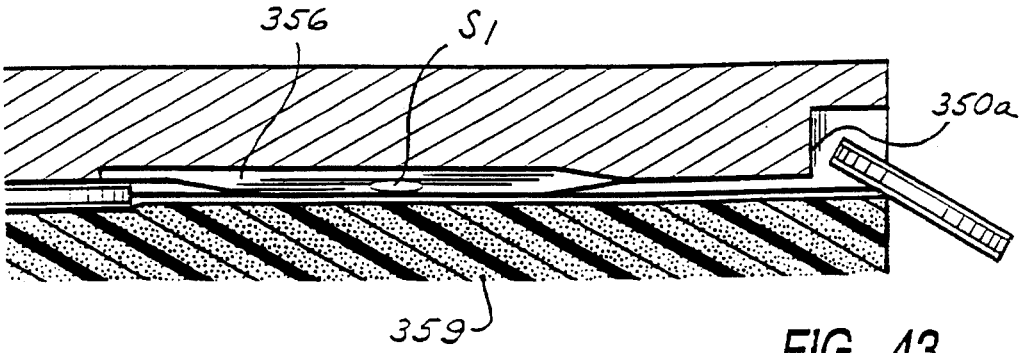
FIG. 43 is a section taken generally along line 43—43 in FIG. 41.

To ensure that the coins are pressed into the resilient surface of the rotating disc, the depth of each of the exit channels 350–355 must be substantially smaller than the thickness of the coin exited through that channel. In the case of the dime channel 350, the top surface 356 of the channel is inclined, as illustrated in FIGS. 42 and 43, to tilt the coins passing through that channel and thereby ensure that worn dimes are retained within the exit channel. As can be seen in FIG. 42, the sensor $S_1$ is also inclined so that the face of the sensor is parallel to the coins passing thereover.

Because the inclined top surface 356 of the dime channel 350 virtually eliminates any outer wall in that region of the channel 350, the dime channel is extended into the gaging recess 357. In the region where the outer edge of the channel 350 is within the radius $R_g$, the top surface of the dime channel is flat, so as to form an outer wall 358. This outer wall 358 prevents coins from moving outwardly beyond the gaging radius $R_g$ before they have entered one of the exit channels. As will be described in more detail below, the disc which carries the coins can recoil slightly under certain stopping conditions, and without the outer wall 358 certain coins could be moved outwardly beyond the radius $R_g$ by small recoiling movements of the disc. The wall 358 retains the coins within the radius $R_g$, thereby preventing the missorting that can occur if a coin moves outside the radius $R_g$ before that coin reaches its exit channel. The inner wall of the channel 350 in the region bounded by the wall 358 is preferably tapered at an angle of about 45° to urge coins engaging that edge toward the outer wall 358.

The inclined surface 356 is terminated inboard of the exit edge 350 of the exit channel to form a flat surface 360 and an outer wall 361. This wall 361 serves a purpose similar to that of the wall 358 described above, i.e., it prevents coins from moving away from the inner wall of the exit channel 350 in the event of recoiling movement of the disc after a braked stop.

Figure 41:
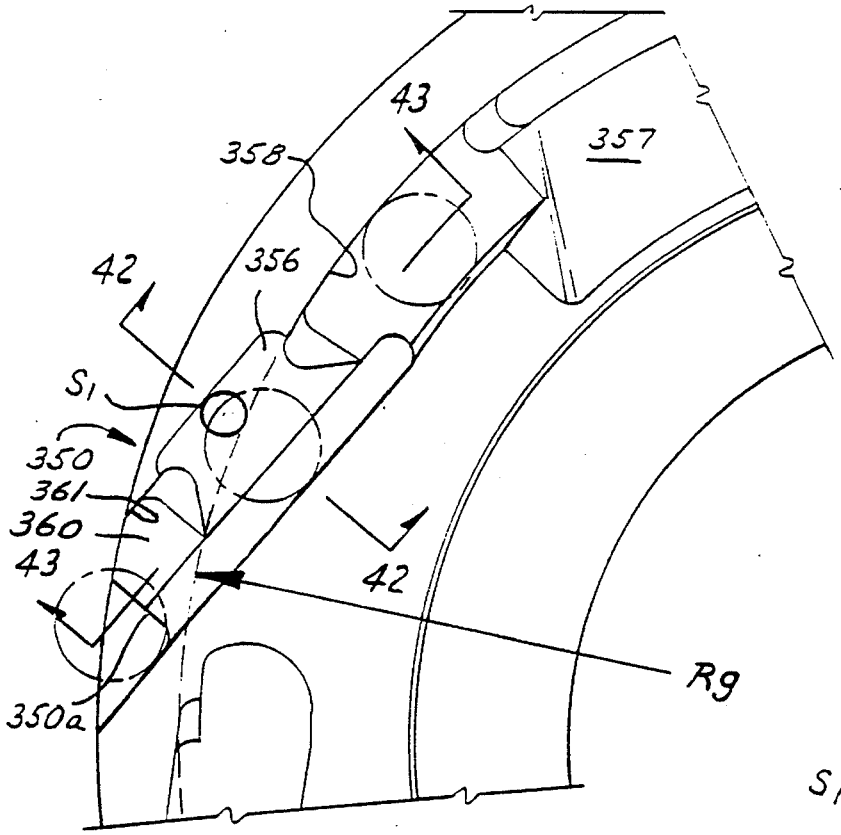
FIG. 41 is an enlarged plan view of a portion of the sorting head shown in FIG. 38.

As shown in FIGS. 38, 41 and 43, the exit end of each exit channel is terminated along an edge that is approximately perpendicular to the side walls of the channel. For example, in the case of the dime exit channel 350 shown in FIGS. 41–43, the exit channel terminates at the edge **350*a*. Although the upper portion of the sorting head extends outwardly beyond the edge 350*a*, that portion of the head is spaced so far above the disc and the coins (see FIG. 43**) that it has no functional significance.

Having the exit edge of an exit channel perpendicular to the side walls of the channel is advantageous when the last coin to be discharged from the channel is followed closely by another coin. That is, a leading coin can be completely released from the channel while the following coin is still completely contained within the channel. For example, when the last coin in a desired batch of n coins is closely followed by coin n+1 which is the first coin for the next batch, the disc must be stopped after the discharge of coin n but before the discharge of coin n+1. This can be more readily accomplished with exit channels having exit edges perpendicular to the side walls.

As soon as any one of the sensors $S_1$–$S_6$ detects the last coin in a prescribed count, the disc 359 is stopped by de-energizing or disengaging the drive motor and energizing a brake. In a preferred mode of operation, the disc is initially stopped as soon as the trailing edge of the "last" or nth coin clears the sensor, so that the nth coin is still well within the exit channel when the disc comes to rest. The nth coin is then discharged by jogging the drive motor with one or more electrical pulses until the trailing edge of the nth coin clears the exit edge of its exit channel. The exact disc movement required to move the trailing edge of a coin from its sensor to the exit edge of its exit channel, can be empirically determined for each coin denomination and then stored in the memory of the control system. The encoder pulses are then used to measure the actual disc movement following the sensing of the nth coin, so that the disc 359 can be stopped at the precise position where the nth coin clears the exit edge of its exit channel, thereby ensuring that no coins following the nth coin are discharged.

Figure 44A:
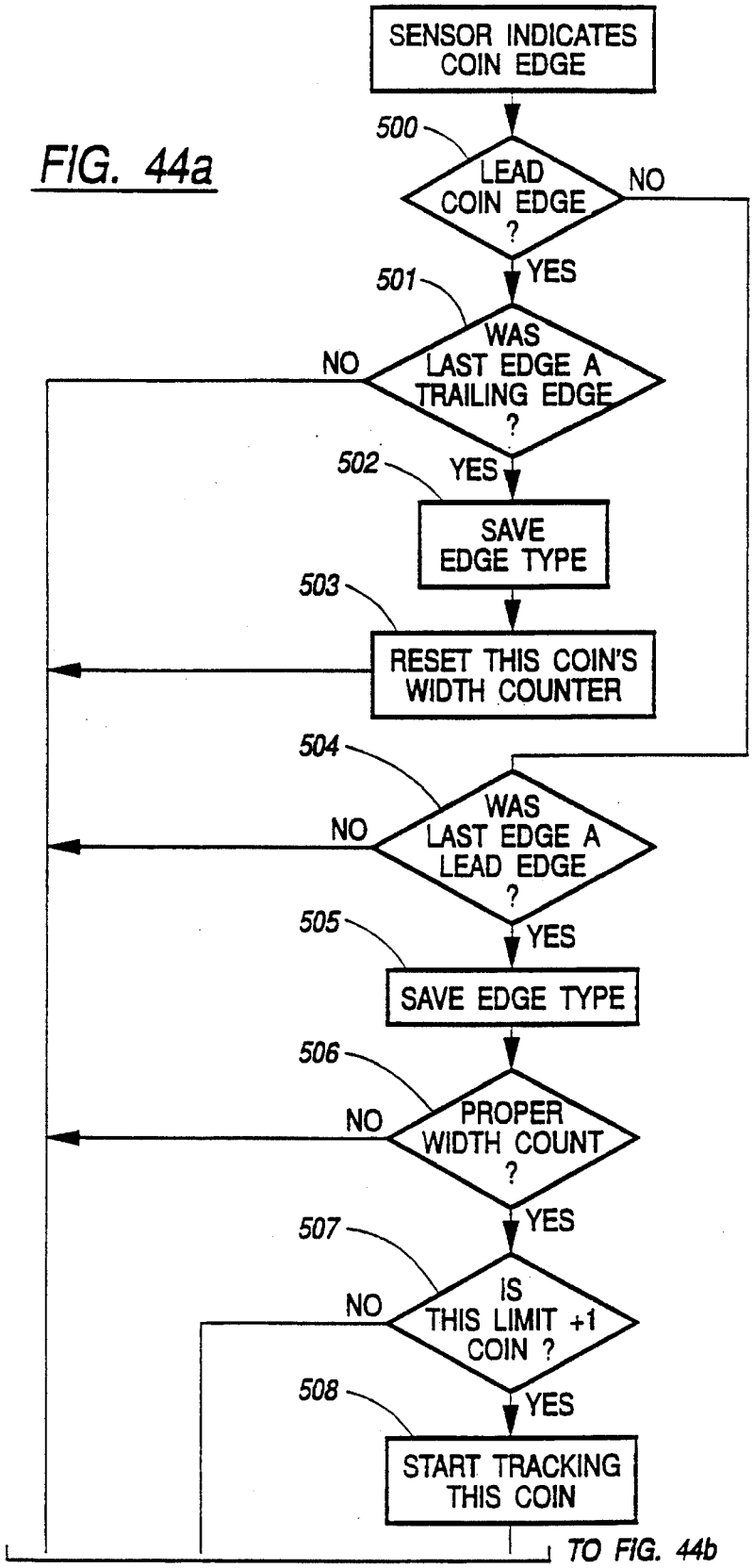
FIGS. 44*a* and 44*b* form a flow chart of a microprocessor program for controlling the disc drive motor and brake in a coin sorter using the modified sorting head of FIG. 38.
Figure 44B:
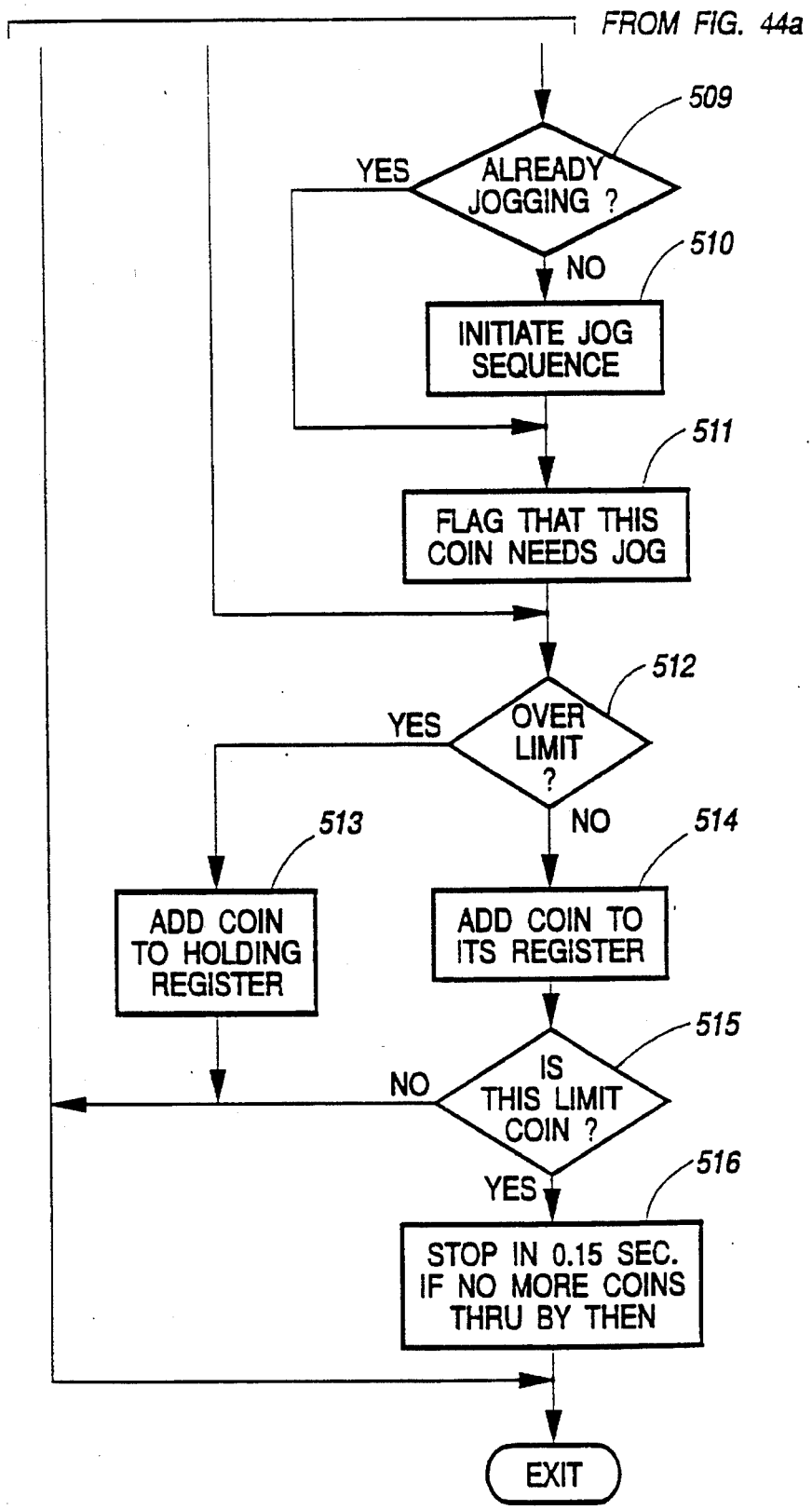
Figure 45A:
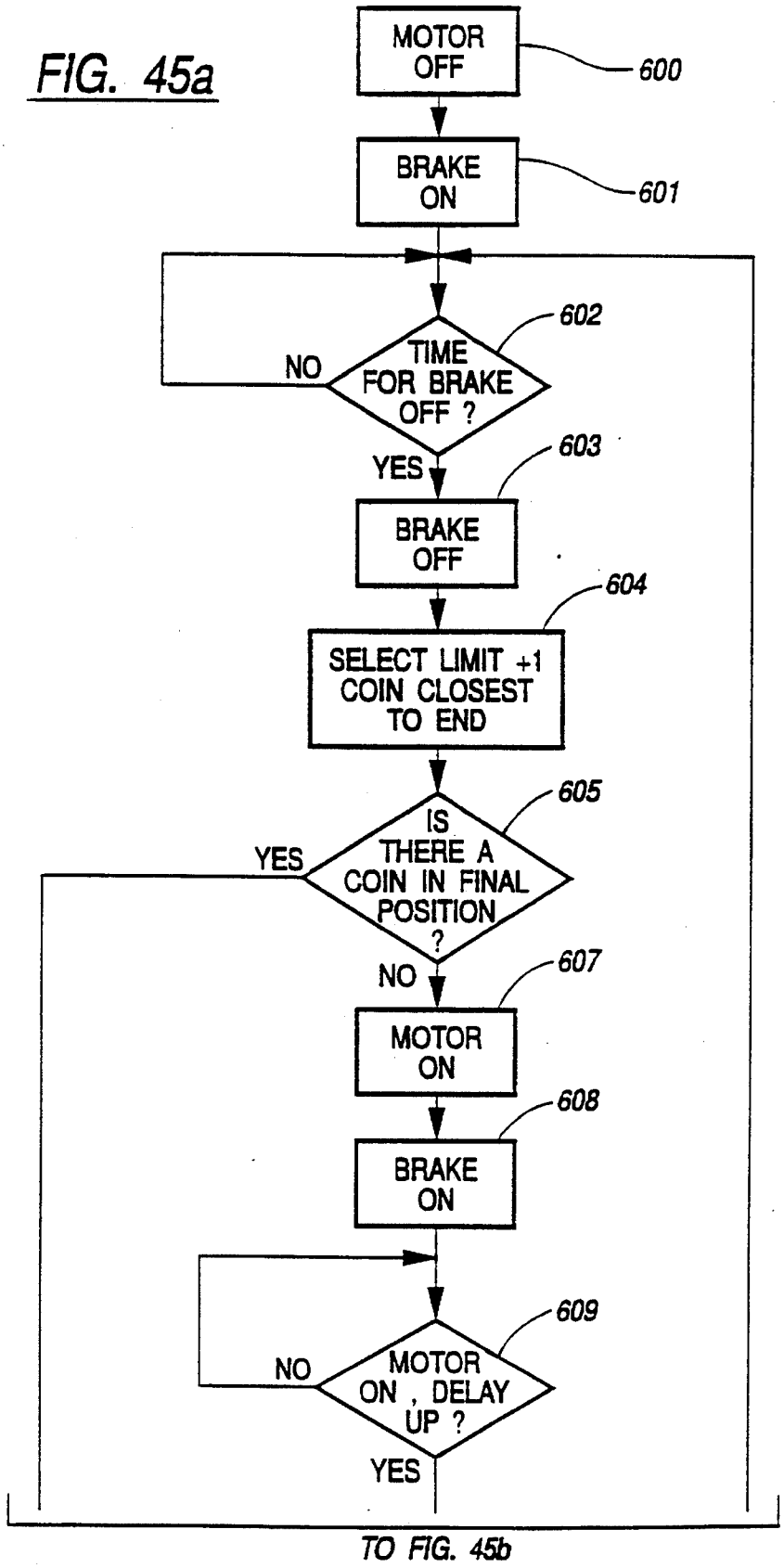
FIGS. 45*a* and 45*b* form a flow chart of a "jog sequence" subroutine initiated by the program of FIGS. 44*a* and 44*b*.
Figure 45B:
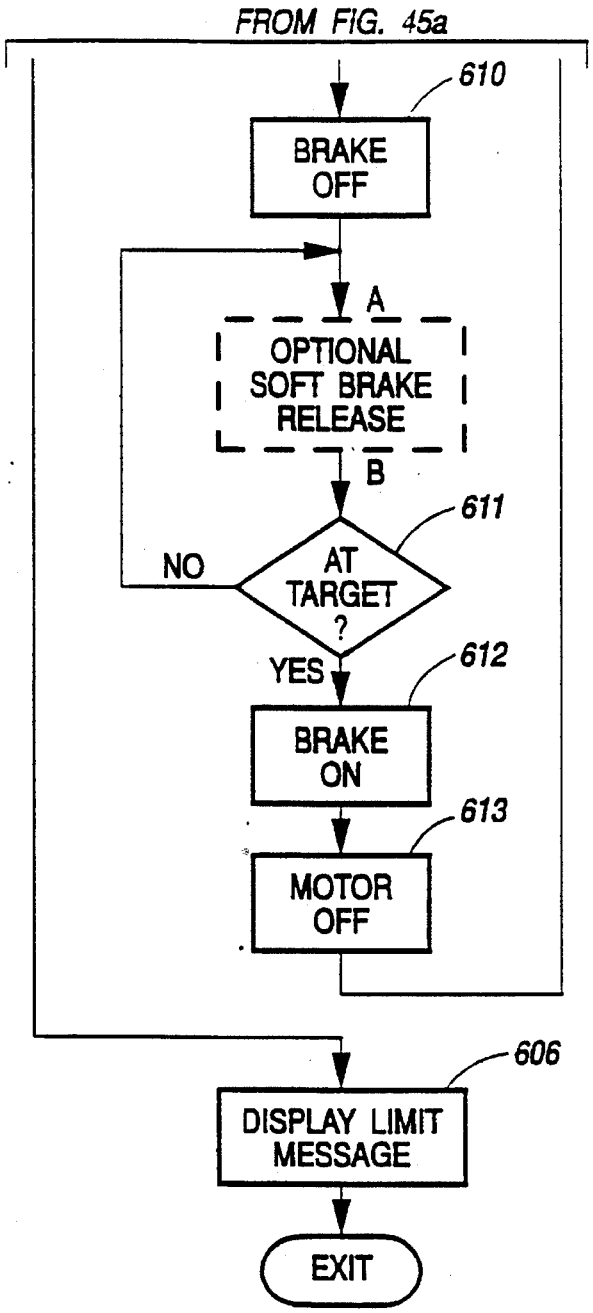
Figure 46:
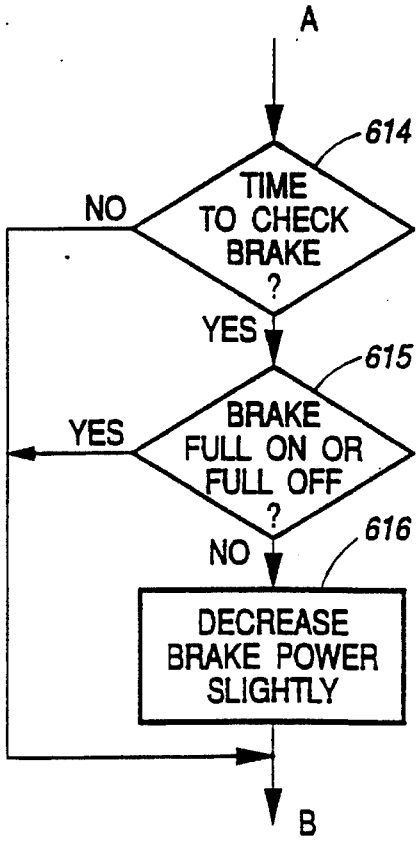
FIG. 46 is a flow chart of an optional subroutine that can be initiated by the subroutine of FIGS. 45*a* and 45*b*.
Figure 47:
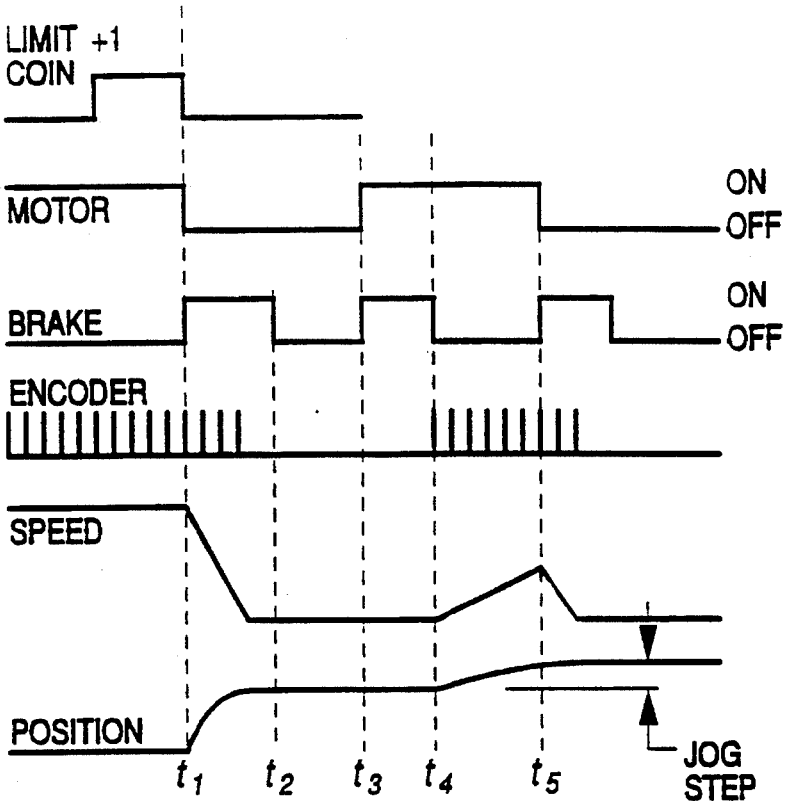
FIG. 47 is a timing diagram illustrating the operations controlled by the subroutine of FIGS. 45*a* and 45*b*.
Figure 48:
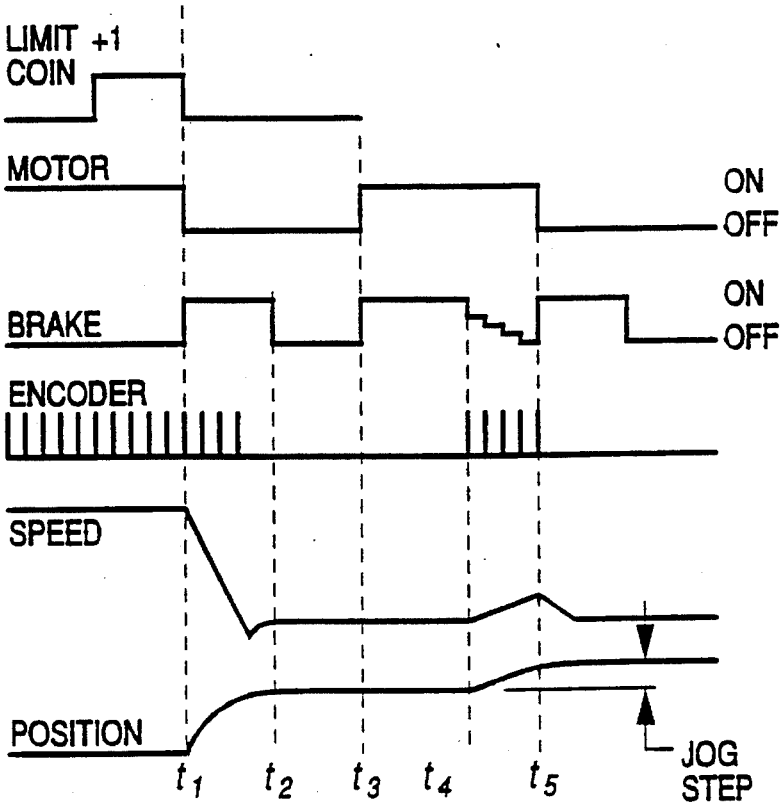
FIG. 48 is a timing diagram illustrating the operations controlled by the subroutines of FIGS. 45 and 46.

The flow chart of a software routine for controlling the motor and brake following the sensing of the nth coin of any denomination is illustrated in FIGS. 44–46, and corresponding timing diagrams are shown in FIGS. 47 and 48. This software routine operates in conjunction with a microprocessor receiving input signals from the six proximity sensors $S_1$–$S_6$ and the encoder 212, as well as manually set limits for the different coin denominations. Output signals from the microprocessor are used to control the drive motor and brake for the disc 359. One of the advantages of this program is that it permits the use of a simple a-c. induction motor as the only drive motor, and a simple electromagnetic brake. The routine charted in FIGS. 44*a* and 44*b* is entered each time the output signal from any of the sensors $S_1$–$S_6$ changes, regardless of whether the change is due to a coin entering or leaving the field of the sensor. The microprocessor can process changes in the output signals from all six sensors in less time than is required for the smallest coin to traverse its sensor.

The first step of the routine in FIG. 44*a* is step 500 which determines whether the sensor signal represents a leading edge of the coin, i.e., that the change in the sensor output was caused by metal entering the field of the sensor. The change in the sensor output is different when metal leaves the field of the sensor. If the answer at step 500 is affirmative, the routine advances to step 501 to determine whether the previous coin edge detected by the same sensor was a trailing edge of a coin. A negative answer indicates that the sensor output signal which caused the system to enter this routine was erroneous, and thus the system immediately exits from the routine. An affirmative answer at step 501 confirms that the sensor has detected the leading edge of a new coin in the exit slot, and this fact is saved at step 502. Step 503 resets a coin-width counter which then counts encoder pulses until a trailing edge is detected. Following step 503 the system exits from this routine.

A negative response at step 500 indicates that the sensor output just detected does not represent a leading edge of a coin, which means that it could be a trailing edge. This negative response advances the routine to step 504 to determine whether the previous coin edge detected by the same sensor was a leading edge. If the answer is affirmative, the system has confirmed the detection of a trailing coin edge following the previous detection of a leading coin edge. This affirmative response at step 504 advances the routine to step 505 where the fact that a trailing edge was just detected is saved, and then step 506 determines whether the proper number of encoder pulses has been counted by the encoder pulses in the interval between the leading-edge detection and the trailing-edge detection. A negative answer at either step 504 or step 506 causes the system to conclude that the sensor output signal which caused the system to enter this routine was erroneous, and thus the routine is exited.

An affirmative answer at step 506 confirms the legitimate sensing of both the leading and trailing edges of a new coin moving in the proper direction through the exit channel, and thus the routine advances to step 507 to determine whether the sensed coin is an n+1 coin for that particular denomination. If the answer is affirmative, the routine starts tracking the movement of this coin by counting the output pulses from the encoder.

At step 509, the routine determines whether the drive motor is already in a jogging mode. If the answer is affirmative, the routine advances to step 511 to set a flag indicating that this particular coin denomination requires jogging of the motor. A negative response at step 509 initiates the jogging mode (to be described below) at step 510 before setting the flag at step 511.

At step 512, the routine of FIG. 44*b* determines whether the most recently sensed coin is over the limit of n set for that particular coin denomination. If the answer is affirmative, the count for that particular coin is added to a holding register at step 513, for use in the next coin count. A negative response at step 512 advances the routine to step 514 where the count for this particular coin is added to the current count register, and then step 515 determines whether the current count in the register has reached the limit of n for that particular coin denomination. If the answer is negative, the routine is exited. If the answer is affirmative, a timer is started at step 516 to stop the disc at the end of a preselected time period, such as 0.15 second, if no further coins of this particular denomination are sensed by the end of that time period. The purpose of this final step 516 is to stop the disc when the nth coin has been discharged, and the time period is selected to be long enough to ensure that the nth coin is discharged from its exit channel after being detected by the sensor in that channel. If a further coin of the same denomination is sensed before this time period has expired, then the disc may be stopped prior to the expiration of the preselected time period in order to prevent the further coin from being discharged, as will be described in more detail below in connection with the jogging sequence routine.

Whenever step 510 is reached in the routine of FIG. 44*b*, the jog sequence routine of FIGS. 45*a* and 45*b* is entered. The first two steps of this routine are steps 600 and 601 which turn off the drive motor and turn on the brake. This is time $t_1$ in the timing diagrams of FIGS. 47 and 48, and a timer is also started at time $t_1$ to measure a preselected time interval between $t_1$ and $t_2$; this time interval is selected to be long enough to ensure that the disc has been brought to a complete stop, as can be seen from the speed and position curves in FIGS. 47 and 48. Step 602 of the routine of FIG. 45*a* determines when the time $t_2$ has been reached, and then the brake is turned off at step 603.

It will be appreciated that the n+1 coin may be reached for more than one coin denomination at the same time, or at least very close to the same time. Thus, step 604 of the routine of FIG. 45*a* determines which of multiple sensed n+1 coins is closest to its final position. Of course, if an n+1 coin has been sensed for only one denomination, then that is the coin denomination that is selected at step 604. Step 605 then determines whether the n+1 coin of the selected denomination is in its final position. This final position is the point at which the n+1 coin has been advanced far enough to ensure that the nth coin has been fully discharged from the exit channel, but not far enough to jeopardize the retention of the n+1 coin in the exit channel. Ideally, the final position of the n+1 coin is the position at which the leading edge of the n+1 coin is aligned with the exit edge 350*a* of its exit channel.

When the n+1 coin has reached its final position, step 605 yields an affirmative response and the routine advances to step 606 where a message is displayed, to indicate that the nth coin has been discharged. The routine is then exited. If the response at step 605 is negative, the drive motor is turned on at step 607 and the brake is turned on at step 608. This is time $t_3$ in the timing diagrams of FIGS. 47 and 48. After a predetermined delay interval, which is measured at step 609, the brake is turned off at time $t_4$ (step 610). Up until the time $t_4$ when the brake is turned off, the brake overrides the drive motor so that the disc remains stationary even though the drive motor has been turned on. When the brake is turned off at time $t_4$, however, the drive motor begins to turn the disc and thereby advance both the n+1 coin and the nth coin along the exit channel.

Step 611 determines when the n+1 coin has been advanced through a preselected number of encoder pulses. When step 611 produces an affirmative response, the brake is turned on again at step 612 and the motor is turned off at step 613. This is time $t_5$ in the timing diagrams. The routine then returns to step 602 to repeat the jogging sequence. This jogging sequence is repeated as many times as necessary until step 605 indicates that the n+1 coin has reached the desired final position. As explained above, the final position is the position at which the n+1 coin is a position which ensures that the nth coin has been discharged from the exit channel and also ensures that the n+1 coin has not been discharged from the exit channel. The routine is then exited after displaying the limit message at step 606.

Instead of releasing the brake abruptly at time $t_4$, as indicated in the timing diagram of FIG. 47, the brake may be turned only partially off at step 610 and then released gradually, according to the subroutine of FIG. 46 and the timing diagram of FIG. 48. In this "soft" brake release mode, step 614 measures small time increments following time 14, and at the end of each of these time increments step 615 determines whether the brake is fully on or fully off. If the answer is affirmative, the subroutine exits to step 611. If the answer is negative, the brake power is decreased slightly at step 616. This subroutine is repeated each time the jogging sequence is repeated, until step 615 yields an affirmative response. The resulting "soft" release of the brake is illustrated by the steps in the brake curve following time 14 in FIG. 48.

Figure 49:
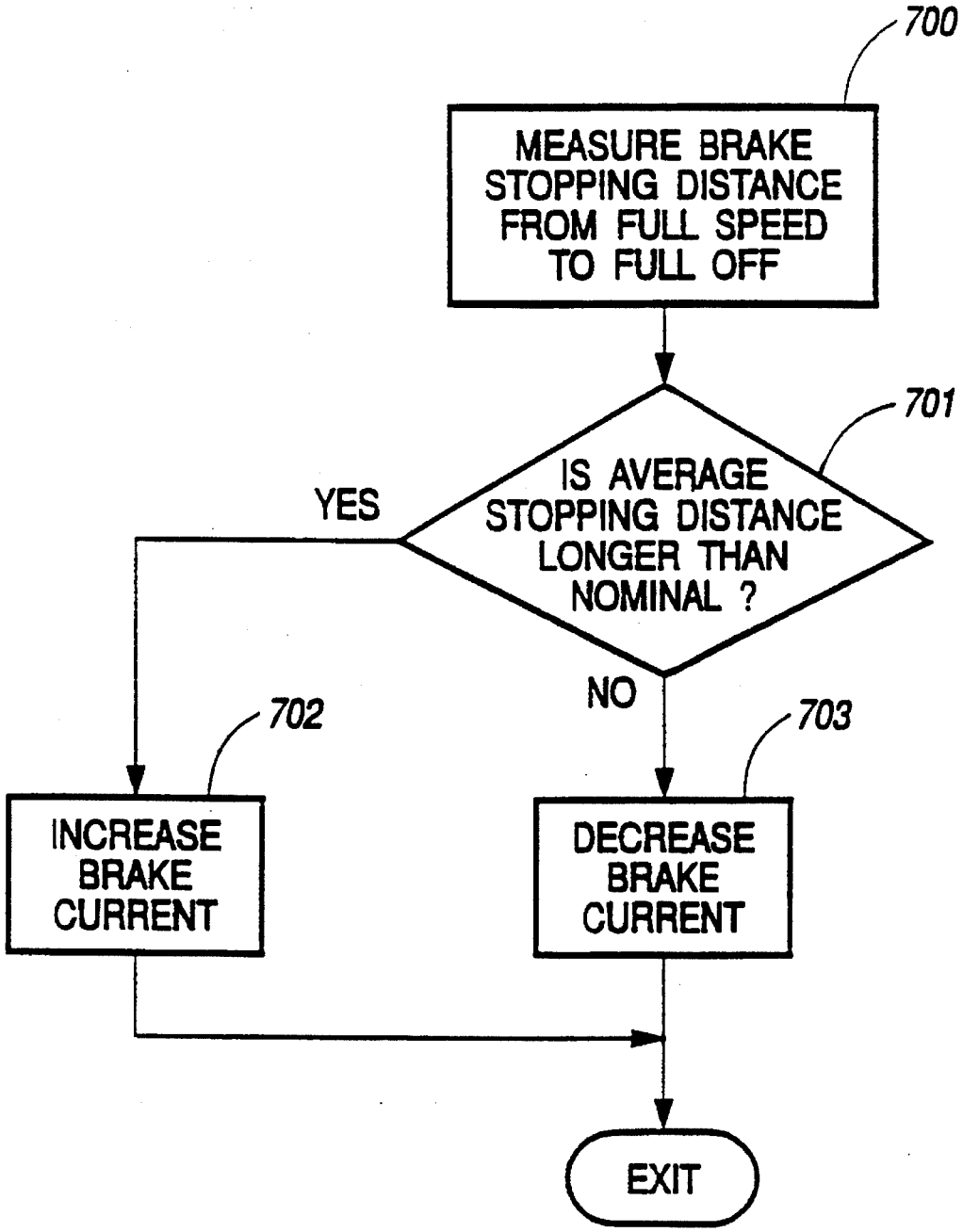
FIG. 49 is a flow chart of a subroutine for controlling the current supplied to the brake.

An additional subroutine, illustrated in FIG. 49, automatically adjusts the energizing current supplied to the brake in order to compensate for variations in the line voltage, temperature and other variables that can affect the stopping distance after the brake has been energized. Step 700 of this subroutine measures the stopping distance each time the brake is turned off. Step 701 then determines whether that measured stopping distance is longer than a preselected nominal stopping distance. If the answer is affirmative, the brake current is increased at step 702, and is the answer is negative, the brake current is decreased at step 703. The subroutine is then exited.

Figure 50:
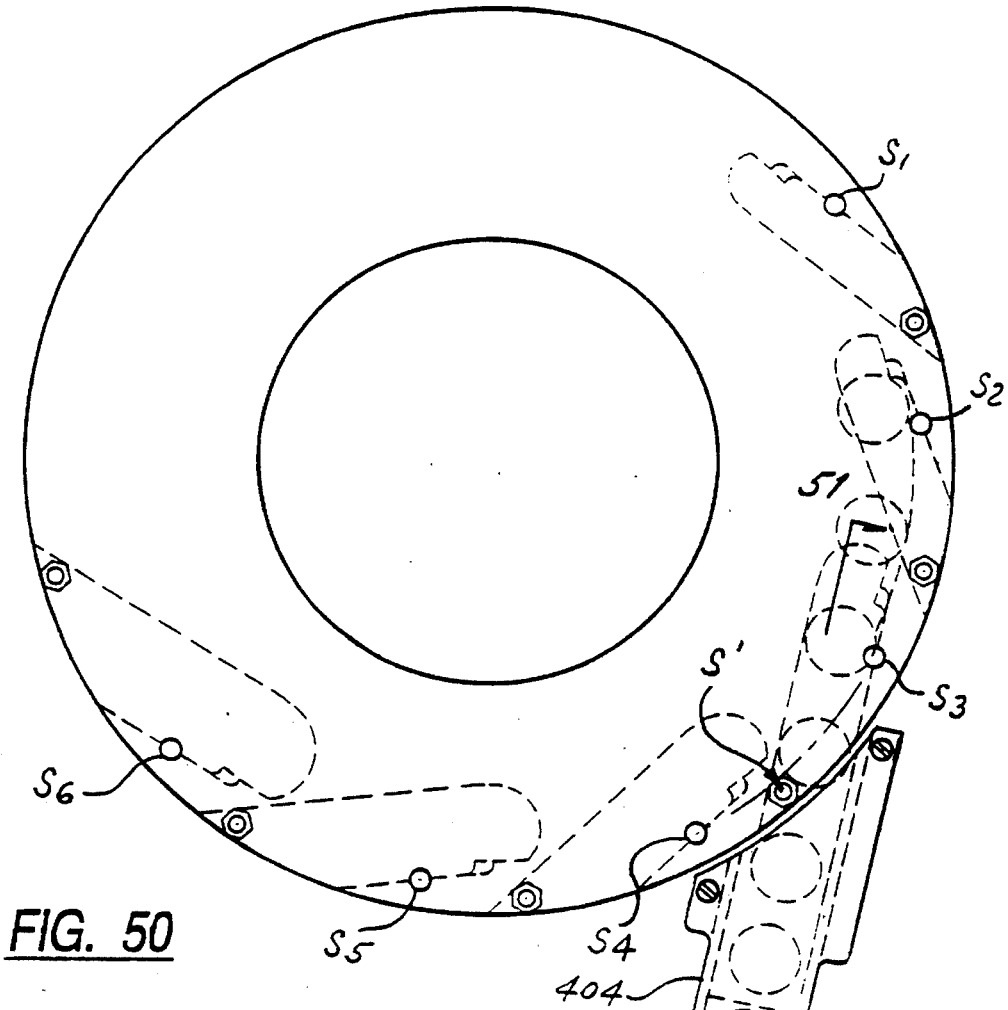
FIG. 50 is a top plan view of another modified sorting head and a cooperating exit chute.
Figure 51:
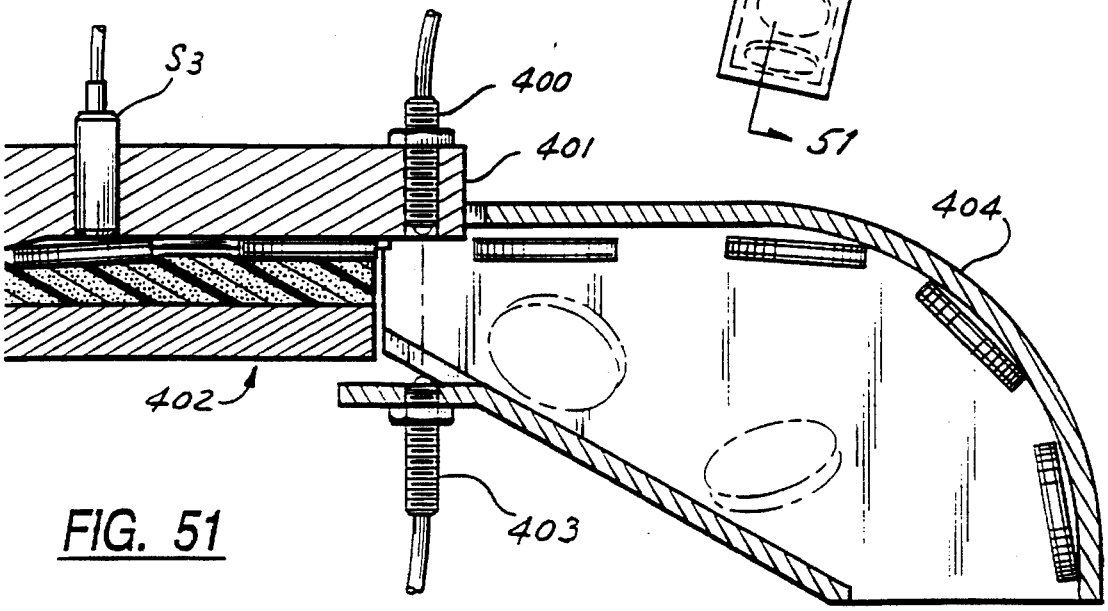
FIG. 51 is an enlarged section taken generally along line 51—51 in FIG. 50.

In the modified embodiment of FIGS. 50 and 51, a second sensor S' is provided outboard of the disc at the end of each exit channel to confirm that the nth coin has, in fact, been discharged from the disc. With this arrangement, no encoder is required and the software routine of FIG. 52 can be utilized. As can be seen in FIG. 51, the second sensor S' is formed by a light source 400 mounted in an extension of the head 401 beyond the disc 402, and a photodetector 403 mounted in the bottom wall on exit chute 404.

Figure 52:
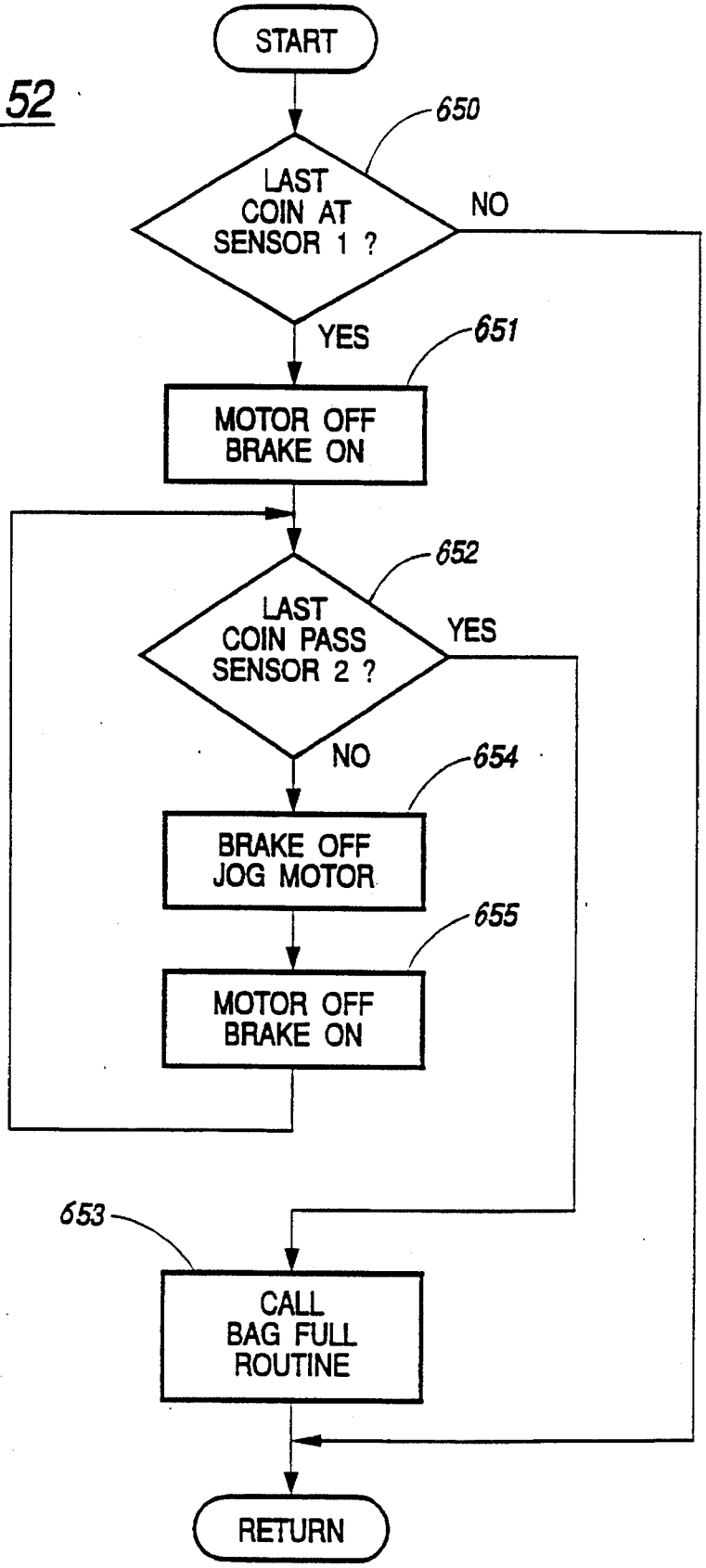
FIG. 52 is a flow chart of a micro-processor program for controlling the disc drive motor and brake in a coin sorter using the modified sorting head of FIG. 50.

The routine of FIG. 52 begins at step 650, which determines whether the coin sensed at the first sensor is the nth coin in the preselected number of coins of that denomination. If the answer is negative, the routine is exited. If the answer is affirmative, the subroutine stops the disc at step 651 by de-energizing the motor and energizing the brake. Step 652 then determines whether the nth coin has been detected by the second sensor S'.

As long as step 652 produces a negative answer, indicating that the nth coin has not been detected by the second sensor S' the routine advances to step 654 which turns off the brake and jogs the motor by momentarily energizing the motor with a controlled pulse. The motor is then immediately turned off again, and the brake is turned on, at step 655. The routine then returns to step 652.

When step 652 produces an affirmative answer, indicating that the nth coin has been detected by the second sensor, a "bag full" routine is entered at step 653. The "bag full" routine ensures that the disc remains stationary until the full bag is removed and replaced with an empty bag.

Figure 53:
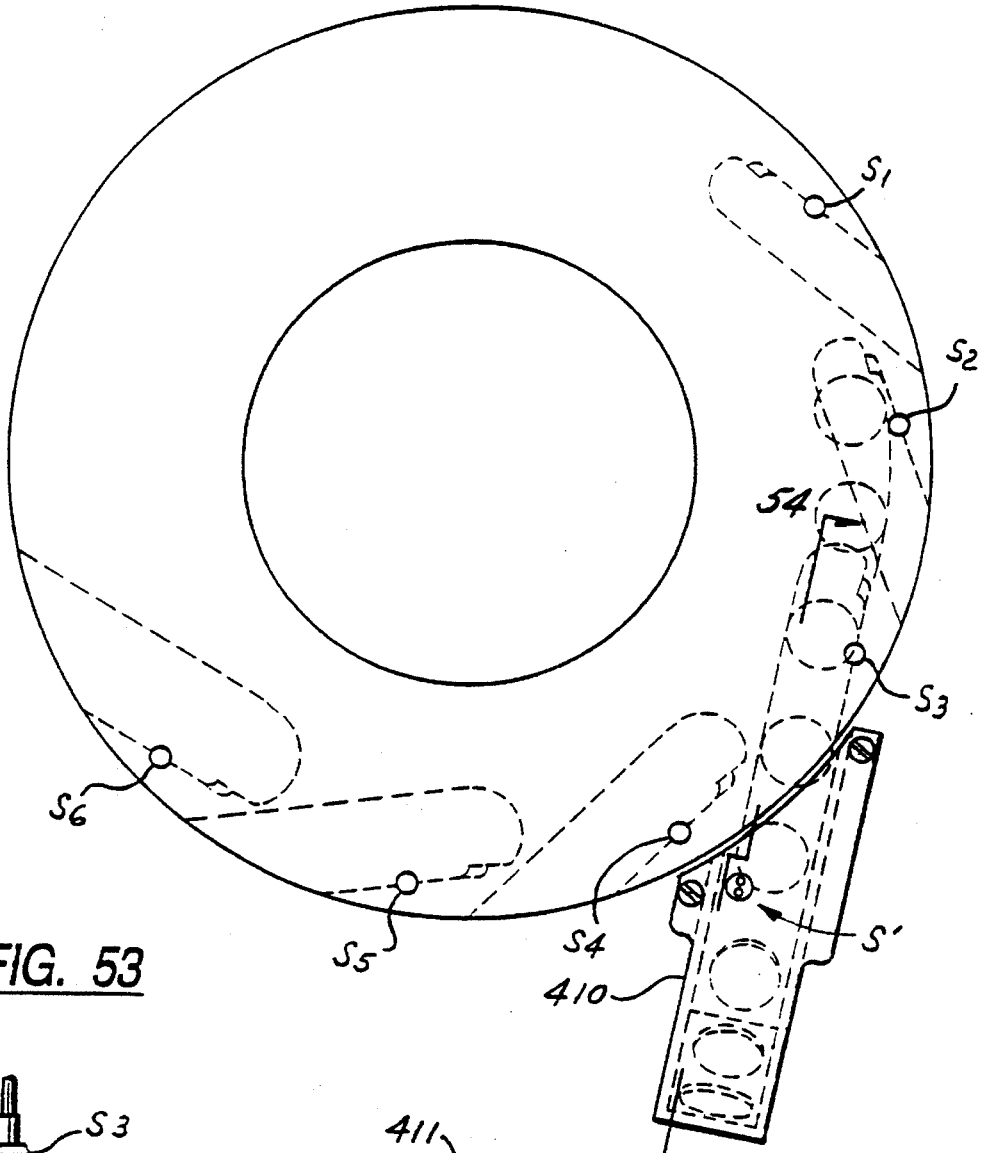
FIG. 53 is a top plan view of another modified sorting head and a cooperating exit chute.
Figure 54:
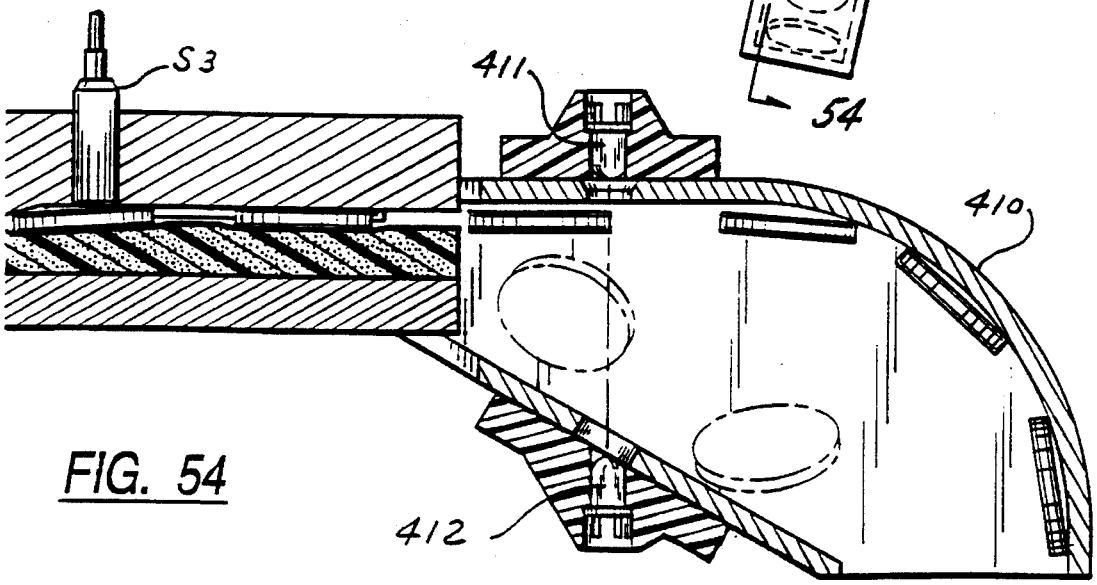
FIG. 54 is an enlarged section taken generally along line 54—54 in FIG. 53.

In FIGS. 53 and 54, there is shown another modified embodiment which the second sensor S' is located entirely in the exit chute 410. Here again, the second sensor S' is formed by a light source 411 and a photodetector 412, but in this case both elements are mounted in the exit chute 410. Also, both the source 411 and the detector 412 are spaced away from the outer edge of the disc by a distance which is approximately the same as the diameter of the particular coin denomination being discharged at this location. Consequently, whenever the sensor S' detects a new coin, that coin has already been released from the disc and the sorting head.

Figure 55:
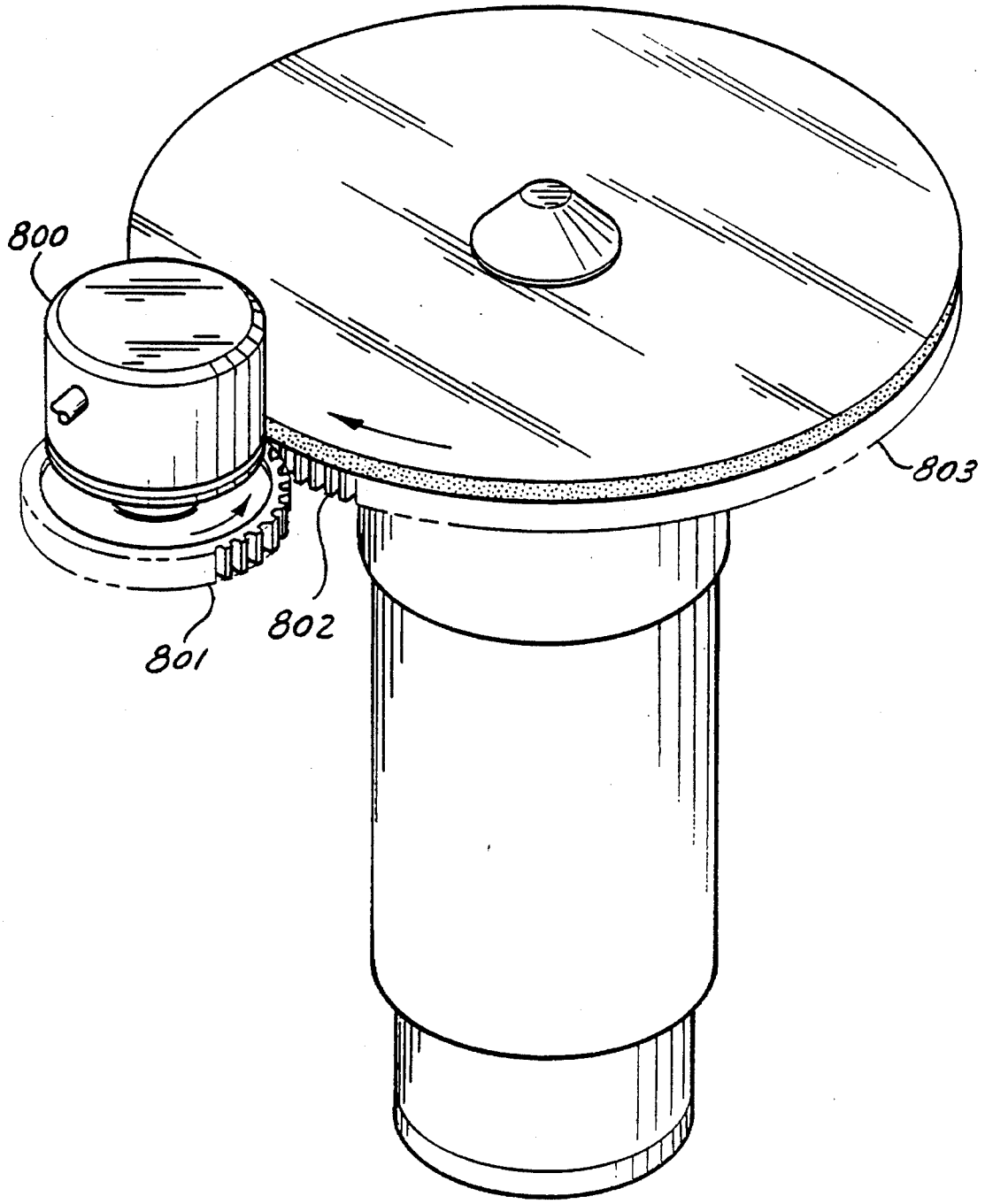
FIG. 55 is a perspective view of a modified encoder for monitoring the angular movement of the disc.

FIG. 55 illustrates a preferred encoder 800 to be used in place of the encoder 212 shown in FIG. 16. The encoder 800 has a gear wheel 801 meshing with gear teeth 802 on the periphery of the metal disc 803. The meshing gear teeth ensure that the encoder 800 positively tracks the rotational movement of the disc 803.

We claim:

1. A disc-type coin sorter for sorting coins of mixed denominations comprising a rotatable disc for receiving said coins and imparting rotational movement to said coins a stationary sorting head having a contoured surface spaced slightly away from and generally parallel to the upper surface of said rotatable disc, means for rotating said disc beneath said sorting head, means for sorting coins on said disc by denomination, separate counting means for sensing and counting the coins of each denomination after the sorting of said coins and while said coins are on the disc, and control means responsive to the counting of the last sorted coin in a preselected count of coins of a selected denomination for stopping the discharge of sorted coins of said selected denomination from the disc after the discharge of said last coin from the disc and before the discharge of the next coin of said selected denomination from the disc following said last coin.

2. A disc-type coin sorter comprising a stationary guide plate having a contoured lower surface arranged slightly above a rotatable coin-carrying disc for sorting coins and discharging said coins at respective exits outside the periphery of the disc according to coin denomination, at least one coin sensor for sensing the position of a selected coin while the coin is on the disc and before the coin is discharged at a respective exit outside the periphery of the disc, and a coin-tracking encoder responsive to the coin sensor for tracking the position of the selected coin relative to said coin sensor as the coin is carried on the disc.

3. The disc-type coin sorter of claim 2 wherein said coin-tracking encoder monitors the angular movement of said disc after the sensing of the selected coin by the coin sensor.

4. A method of controlling the movement of coins of mixed denominations between a stationary head and a rotatable disc having a resilient upper surface located beneath said head and close enough to the lower most surfaces of the head to cause those surfaces to press the coins into said resilient surface, said method comprising sorting the coins and guiding coins of different denominations through different exit channels leading to different discharge stations around the periphery of said disc, sensing and counting the coins of each denomination after the sorting of said coins and while said coins are on the disc, and stopping the discharge of sorted coins of a selected denomination from the disc in response to the counting of the last sorted coin in a preselected count of coins of a selected denomination, and after the discharge of said last coin from the disc and before the discharge of the next coin of said selected denomination from the disc following said last coin.

5. A method of controlling the movement of coins of mixed denominations between a stationary head and a rotatable disc having a resilient upper surface located beneath said head and close enough to the lower most surfaces of the head to cause those surfaces to press the coins into said resilient surface, said method comprising sorting the coins and guiding coins of different denominations through different exit channels leading to different discharge stations around the periphery of said disc, sensing the position of a selected coin while the coin is on the disc and before the coin is discharged at a respective exit outside the periphery of the disc, and tracking the position of the selected coin relative to said sensed position as the coin is carried on the disc.

6. The method of claim 5 wherein said tracking step monitors the angular movement of said disc after the sensing of the selected coin.

* * * * *